US007051838B1

(12) United States Patent
Torrey

(10) Patent No.: US 7,051,838 B1
(45) Date of Patent: May 30, 2006

(54) SCAFFOLDING SYSTEM, INTEGRAL SAFETY RAIL THEREFOR AND METHODS OF MAKING THE SAME

(76) Inventor: Edd C. Torrey, 41 Hogeye Loop, Elkland, MO (US) 65644

( * ) Notice: Subject to any disclaimer, the term of this patent is extended or adjusted under 35 U.S.C. 154(b) by 0 days.

(21) Appl. No.: 10/818,600

(22) Filed: Apr. 6, 2004

Related U.S. Application Data

(60) Provisional application No. 60/472,555, filed on May 22, 2003.

(51) Int. Cl.
*E04G 3/20* (2006.01)

(52) U.S. Cl. ..... 182/82

(58) Field of Classification Search ..... 182/82, 182/230; 52/127.2
See application file for complete search history.

(56) References Cited

U.S. PATENT DOCUMENTS

| | | | | |
|---|---|---|---|---|
| 73,346 | A | 1/1868 | Lamb et al. | |
| 834,919 | A | 11/1906 | Mackie | |
| 1,347,453 | A * | 7/1920 | Garner | 182/230 |
| 2,481,885 | A | 9/1949 | Simpson | |
| 2,966,957 | A | 1/1961 | Ireland | |
| 2,997,767 | A | 8/1961 | Grover et al. | |
| 3,967,694 | A * | 7/1976 | Woolfolk, Sr. | 182/82 |
| 4,068,427 | A * | 1/1978 | Camardo | 52/127.2 |
| 4,078,633 | A | 3/1978 | Fahy | |
| 4,396,092 | A * | 8/1983 | Thompson | 182/38 |
| 4,524,849 | A | 6/1985 | Riddle | |
| 4,641,728 | A | 2/1987 | McCabe | |
| 4,984,654 | A | 1/1991 | Anderson | |
| 5,388,663 | A | 2/1995 | Phillippe et al. | |
| 5,685,391 | A | 11/1997 | Gundlach | |
| 6,065,254 | A | 5/2000 | Lanka | |
| 6,247,273 | B1 | 6/2001 | Nickel | |
| 6,446,752 | B1 | 9/2002 | Philippe | |
| 6,530,456 | B1 | 3/2003 | Wallther | |
| 2002/0073634 | A1 | 6/2002 | Bolinger et al. | |
| 2002/0178683 | A1 | 12/2002 | Phillips | |
| 2004/0020713 | A1 * | 2/2004 | Fregosi et al. | 182/82 |

FOREIGN PATENT DOCUMENTS

FR 2572448 A1 * 5/1986

OTHER PUBLICATIONS

MonoJack by ReechCraft, web information page. ReechCraft, Inc, 2001 1st Ave. North, Fargo, ND 58102.
PanelJack by ReechCraft, web information. ReechCraft, Inc, 2001 1st Ave. North, Fargo, ND 58102.

* cited by examiner

*Primary Examiner*—Alvin Chin-Shue
(74) *Attorney, Agent, or Firm*—Richard L. Marsh

(57) ABSTRACT

An angled brace scaffolding system comprises a plurality of scaffolding brackets, a plurality of adjustable outriggers and a plurality of walkways. The plurality of adjustable outriggers support the scaffolding brackets against a wall with the plurality of walkways spanning between the scaffolding brackets. The scaffolding brackets are a single piece comprising a downwardly extending wall support leg rigidly affixed to one end of an horizontally disposed walkway support and an upwardly extending guard rail post rigidly affixed to the opposite end of the horizontally disposed walkway support. The wall support leg and the walkway support having a gusset formed therebetween for attaching one end of one of the plurality of adjustable outriggers thereupon.

17 Claims, 12 Drawing Sheets

SCAFFOLDING SYSTEM, INTEGRAL SAFETY RAIL THEREFOR AND METHODS OF MAKING THE SAME

RELATED APPLICATION DATA

This Application is a non-provisional application of Applicant's provisional application Ser. No. 60/472,555 filed on 22 May 2003.

BACKGROUND OF THE INVENTION

1. Field of the Invention

This invention relates to a scaffolding system comprising a plurality of step-shaped supports wherein the down leg of each support bears against a wall, the upright leg adapted to receive a safety rail and a walkway support comprising a flat between the legs, each step-shaped support supported above the working surface and against the wall with an outrigger fixed to the apex between the down leg and the walkway support. A guard rail is pinned to each upright leg thus becoming an integral structural part of the scaffolding system. The scaffolding system may also be made freestanding by clamping together the down legs of two step-shaped supports in opposed relationship using the outrigger to establish a tripod sub-assembly. Thereafter, two sub-assemblies are spaced apart and joined by walk boards or stages placed upon the walkway supports.

2. Prior Art Statement

It is known to provide a scaffold for a building comprising brackets and shore timbers wherein the brackets are raised and lowered with facility by pinning the foot of the shore timbers nearer or further from the wall. For instance, see the U.S. Pat. No. 73,346 issued on 14 Jan. 1868, to Lamb and Livings. It is further known to hold a bracket against a building wall with a joist or studding. For instance, see the U.S. Pat. No. 834,919 issued on 6 Nov. 1906 to Frank Mackie. Also, it is known to construct a scaffold with two or more brackets resting against an upright wall with a prop embedded in and resting upon the ground or floor wherein the prop is retained against the bracket by a pin through a triangular plate. See the U.S. Pat. No. 1,347,453 issued on 20 Jul. 1920, to Karl Gamer. Additionally, known is the MonoJack System manufactured by ReechCraft wherein individual brackets are supported against a wall by a telescoping leg section. The Mackie scaffold must be anchored to the wall. In all of the above scaffolds, each bracket is independently supported against the wall without structural relationship to any other bracket. Furthermore, no safety rails are provided between the brackets nor is provision made for adding safety rails. The individual brackets and braces, when subjected to side loads, tend to slide along the wall causing failure of the scaffold.

It is also known to provide a pair of standards arranged in an upwardly converging direction positioned below an horizontally disposed timber supporting member wherein one end of the timber supporting member is pivotally connected to the apex of the upwardly converging members and while the other end has a foot thereon which rests against the wall. For instance, see the U.S. Pat. No. 2,966,957 issued on 3 Jan. 1961 to Herbert Ireland or the U.S. Patent Publication 2002/0178683 A1, published on 5 Dec. 2002 by Robert M. Phillips. No safety rail is provided nor is provision made to add a safety rail. Additionally, the standards are adapted to use planking laid upon the horizontal leg and are not suitable for use with modern walkboards.

It is further known to provide an adjustable bracing system for bracing of insulated concrete walls during the construction thereof, the system comprising a substantially vertical brace, an adjustable length angled leg member, a scaffolding framework extending substantially horizontally and mounted along a first edge of the brace wherein the angled leg member is fixed to the vertical brace. For instance, see U.S. Pat. No. 5,388,663 issued on 14 Feb. 1995 to Phillippe, et al., U.S. Pat. No. 6,065,254 issued on 23 May 2000 to Richard Lanka, the U.S. Pat. No. 6,247,273 issued on 19 Jun. 2001 to Shane Nickel, the PanelJack offered for sale by ReechCraft, the U.S. Pat. No. 6,446,752 issued on 10 Sep. 2002 to Michel Philippe and the U.S. Publication 2002/0073634 A1 issued on 20 Jun. 2002 by Bolinger, et al. The scaffolding systems described in Phillippe, et al., and Bolinger, et al., must be anchored to the wall with straps surrounding the legs of the scaffolding brackets. Although most of these patents have provisions for adding a safety rail having a standard loosely placed in a socket at the end of the walkway support, the safety rail is not structurally sound nor does the safety rail provide structural support to the scaffolding system. Furthermore, these bracing systems are suitable for standard planking laid upon the horizontal members and generally do not accept modern walkboards which positively engage each horizontal member.

It is known to provide a free standing, square rigged scaffolding system comprising at least two substantially square end members joined together with cross braces preferably on both side edges to lend rigidity to the scaffolding system. Planking is then laid upon the crossbars of the end members wherein the worker walks upon the walk boards while working in the elevated position. The square rigged scaffold is difficult to erect and must be placed on a substantially level surface as there is limited adjustment to the height of each leg. Square rigged scaffolding may only be extended upwardly by building additional end members upon the tops of the next lower end member by the worker working in an elevated position. Furthermore, no safety rails have been provided for square rigged scaffolds nor is provision made for safety rails. The time required to erect square rigged scaffolding would not permit rapid deployment of repair crews in an hostile environment. For instance, see the U.S. Pat. No. 2,481,885 issued on Sep. 13, 1949 to Eugene H. Simpson.

Provisions have been made to lock pre-made staging to square rigged, free standing scaffolding by providing a hook like portion on the end of the walkway with a locking element associated therewith. For instance, see the U.S. Pat. No. 2,997,767 issued on Aug. 29, 1961 to Grover, et al., or the U.S. Pat. No. 6,530,456 B1 issued on Mar. 11, 2003 to Harry Wallther. The staging described in these patents requires manipulation of a latch on both ends of the staging in order to secure same to the scaffold.

A safety improvement on pre-made staging for a square rigged scaffold system comprises a guard post and means for coupling the post to pre-made staging is shown in U.S. Pat. No. 4,984,654 issued on Jan. 15, 1991 to Carl Anderson. As the guard posts are fixed only to the staging, no additional structural integrity is provided to the scaffolding system as impact against the guard post or any associated guard rail would tip the pre-made staging along with the safety rail possibly resulting in injury to the worker.

A tripod joint has been proposed for a tripod step ladder which comprises a C-shaped link to join together the legs of the tripod while allowing the tripod to be collapsed for ease of transport. The link binds the splayed legs of the tripod against the ladder leg. For instance, see the U.S. Pat. No.

4,524,849 issued on Jun. 25, 1985 to Ronald Riddle. Though not discussed or shown by the inventor, the tripod system might conceivably be used as ends of a scaffolding system by placing planking upon the steps of the opposed ladders, the height of such a ladder/scaffold is limited to the length of the ladder. No safety rails or other safety measures have been provided for retaining the worker upon the ladder/scaffold.

A tripod ladder is described in U.S. Pat. No. 5,685,391 issued on Nov. 11, 1997 to James Gundlach, the tripod consisting of at least one extendible ladder joined to two other legs with a triangular member. In practice, the triangular member may only be affixed to the top most rung on the ladder with the other two legs splayed outwardly on a flat surface at 120 degrees which requires considerable space to assemble the ladder. Most construction locations have limited space to erect elevated platforms and the tripod ladder of this invention would not allow erection in a limited space. Furthermore, no scaffolding is contemplated by the inventor nor would it be practical to use the tripod so described as so much erection space is required.

Finally, it is known to provide free standing towers for a scaffolding system as shown in U.S. Pat. No. 4,641,728 issued on Feb. 10, 1987. Each tower comprises an upstanding mast and a three-legged base. One leg of the base is fixed to the mast while the other two legs are swingable adjacent the mast. Each mast must be leveled using adjusting screws on the ends of the legs prior to finishing erection. Since the adjusting screws have limited movement, the use of this scaffolding system is generally limited to substantially level ground. Safety rails are provided but are loosely held in sockets at the extents of horizontal staging, the horizontal staging affixed to a sleeve sliding upon the mast. The scaffolding system must be anchored to the wall being erected at heights above twelve feet.

SUMMARY OF THE INVENTION

As the individual brackets of the prior art are subject to side loads when used in the usual manner, failure of the entire scaffolding system is possible as no additional structural integrity is provided to the individual brackets by the walkboards. Furthermore, though most previous scaffolding does not provide for addition of safety rails as required by the Occupational Safety and Health Administration, scaffolding systems that accept safety rails do not provide any additional structural support to the system, nor are the safety rails adequate for workers in an elevated position. Therefore, it is an object of this invention to provide a scaffolding system comprising a plurality of scaffolding brackets with associated adjustable braces, hereinafter scaffolding units, the scaffolding units integrally linked together through at least the safety rail, the staging and/or an angular brace.

One objective of this invention is to provide scaffolding units integrally linked together through at least the safety rail, the staging and/or an angular brace wherein each scaffolding unit is supported above a surface by an adjustable outrigger, the outrigger comprising a plurality of telescoping sections, each successive telescoping section progressively smaller in cross section than the next lower section. The telescoping sections have a plurality of aligned pin holes disposed transversely through the opposed side walls thereof, the aligned pin holes adapted to receive an implement pin therein for fixing each telescoping section into a predefined length.

One purpose of this invention is to provide an angled brace scaffolding system supported above a surface by a plurality of adjustable outriggers, at least one of the outriggers carrying a foot upon the free end thereof wherein the foot is selected from a group comprising an articulated channel shaped member with a rubberized bottom surface, an enlarged plate member having spikes on an underside surface thereof, an enlarged spike which may be withdrawn into the free end of the outrigger, an enlarged plate member having an open mesh between the peripheral edges thereof, an enlarged plate having an open mesh between the peripheral edges thereof and spikes protruding from one surface thereof.

One aim of this invention is to provide an adjustable outrigger has a yoke on one end and carries an adjustable clevis on the other end thereof, the yoke releasably affixed to the adjustable outrigger supporting one scaffolding bracket and the adjustable clevis releasably affixed to the adjustable outrigger supporting an adjacent scaffolding bracket.

It is an aim of this invention to provide an angled brace scaffolding system comprising a plurality of scaffolding brackets, a plurality of adjustable outriggers, a plurality of stages, wherein the plurality of adjustable outriggers support the scaffolding brackets against a wall and the plurality of stages span between the scaffolding brackets. Each scaffolding bracket is a single piece comprising a downwardly extending wall support leg rigidly affixed to one end of a horizontally disposed walkway support and an upwardly extending guard rail post rigidly affixed to the opposite end of the horizontally disposed walkway support, the wall support leg and walkway support having a gusset formed therebetween for attaching one end of one of the plurality of adjustable outriggers thereupon.

A principal object of this invention is to provide a freestanding scaffolding system comprising two opposed tripod end members spaced apart by and joined together with at least one staging platform wherein the tripod end members comprise two scaffolding brackets having downwardly extending wall support legs joined together in opposed relation. Each scaffolding bracket carries therewith an adjustable outrigger rotatably supported in a gusset formed between the downwardly extending support leg and an integral walkway support, the tripod end member having an adjustable tripod outrigger rotatably supported in a coupling member joining the downwardly extending support legs of the scaffolding brackets together.

A goal of this invention is to provide a freestanding scaffolding system having a gusset formed between a downwardly extending support leg and an integral walkway support, the gusset having a curved outer peripheral arcuate strut with a center point proximate the juncture between the downwardly extending support leg and the integral walkway support, the curved outer peripheral arcuate strut comprising a pair of arcuate members spaced apart a distance equal to the outside dimension of the downwardly extending support leg of the scaffolding bracket. The arcuate members of the peripheral arcuate strut also have a plurality of aligned holes disposed therethrough for affixing an adjustable outrigger in one of a plurality of defined angular positions relative to the scaffolding bracket.

Another objective of this invention is to provide a freestanding scaffolding system having a gusset formed between a downwardly extending support leg and an integral walkway support, the gusset having a curved outer peripheral arcuate strut having holes provided therein wherein one the plurality of holes at the defined angular position receives a farm trailer pin therethrough wherein the farm trailer pin passes through one of the arcuate members then through the adjustable outrigger and finally through the other of the arcuate members, the farm trailer pin retained in the holes with a keeper disposed through the free end thereof.

One intention of this invention is to provide a freestanding scaffolding system wherein the integral walkway support of each scaffolding bracket is disposed in a substantially horizontal position by adjusting at least one adjustable outrigger, the freestanding scaffolding system retained in the substantially vertical plane by a tripod outrigger wherein the adjustable outriggers and the tripod outrigger are retained in the desired position by a chain releasably captured on an implement pin placed through one of holes in lowermost section adjacent juncture of lowermost section and the next successive section of each the adjustable outriggers.

A main purpose of this invention is to provide a freestanding scaffolding system that maintains the working staging of one scaffolding bracket substantially level by establishing the defined angular position of one adjustable outrigger of one scaffolding bracket substantially equal to the defined angular position of the adjustable outrigger of another scaffolding bracket wherein the tripod end member of the freestanding scaffolding system is erected on a level surface.

Another goal of this invention is to provide freestanding scaffolding system that maintains the working staging of one scaffolding bracket of each tripod end member substantially level wherein the defined angular position of one adjustable outrigger of one scaffolding bracket is different than the defined angular position of the adjustable outrigger of the other scaffolding bracket of the tripod end member where the tripod end member is erected on an uneven surface.

It is another aim of this invention to provide a tripod end member for a freestanding scaffolding system, the tripod end member comprising a pair of scaffolding brackets arranged and joined in opposed relationship, each scaffolding bracket supported by an adjustable outrigger, wherein the adjustable outriggers are disposed in a substantially vertical plane and wherein the tripod end member is supported in the vertical plane by a tripod outrigger which extends downwardly from a coupling member joining the scaffolding brackets together, the tripod outrigger set in a plane perpendicular to the substantially vertical plane of the scaffolding bracket and adjustable outriggers.

A further aim of this invention is to provide a scaffolding system that may be quickly erected for use in hostile environs.

Another purpose of this invention is to provide single piece scaffolding brackets comprising a downwardly extending wall support leg rigidly affixed to one end of an horizontally disposed walkway support and an upwardly extending guard rail post rigidly affixed to the opposite end of said horizontally disposed walkway support thus providing for integral safety support standards for a scaffolding system.

One main goal of this invention it so provide a scaffolding system in compliance with OSHA regulations.

DESCRIPTION OF THE PREFERRED EMBODIMENTS

While the various features of this invention are hereinafter described and illustrated as a scaffolding system consisting of a plurality of scaffolding units, each scaffolding unit comprising a scaffolding bracket with an associated adjustable brace, the scaffolding units linked together through at least the safety rail, the staging and/or an angular brace it is to be understood that the various features of this invention can be used singly or in various combinations thereof for a scaffolding system comprising a plurality of scaffolding units integrally linked together as can hereinafter be appreciated from a reading of the following description.

Figure 1:
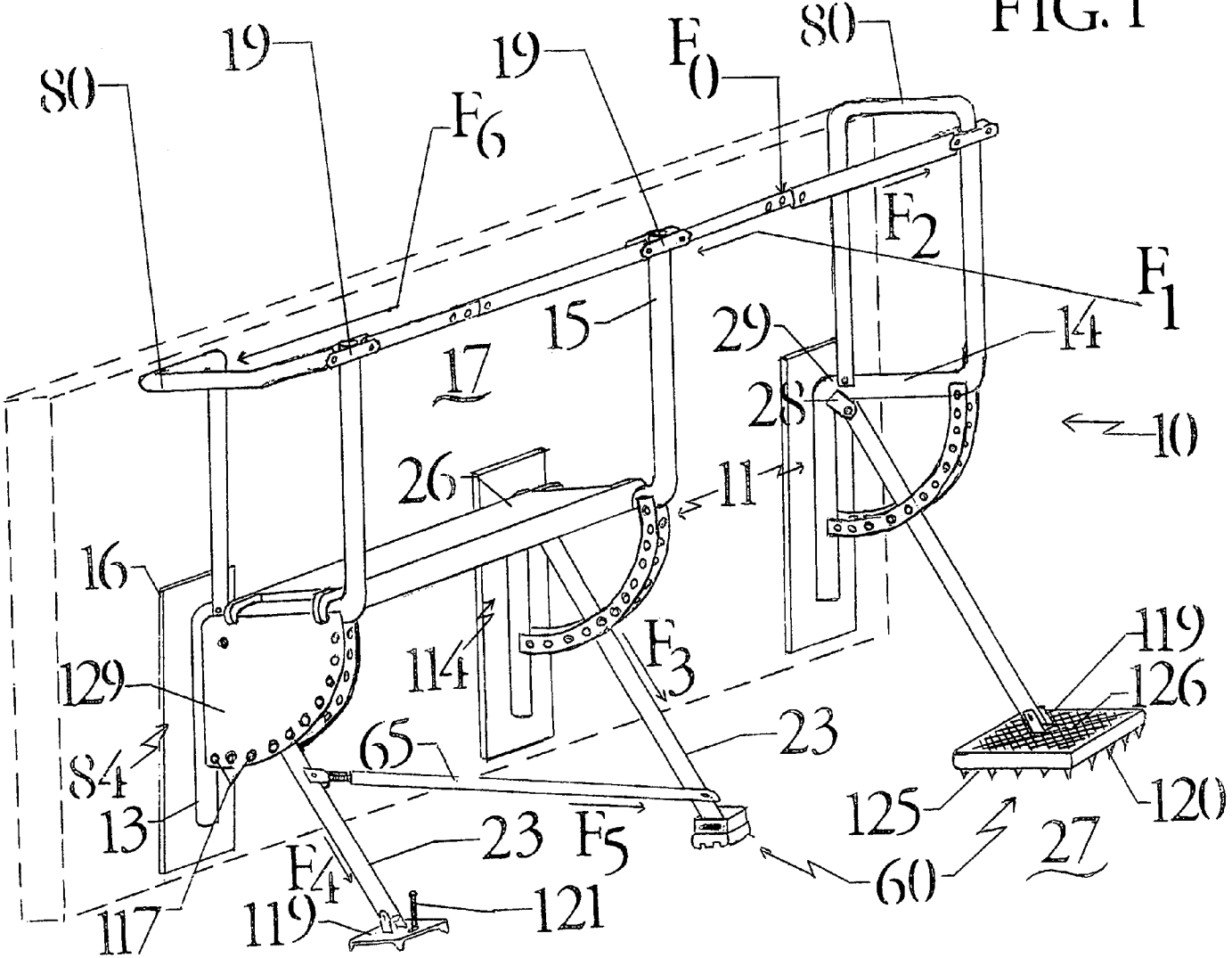
FIG. 1 is a right perspective view of an embodiment of the scaffolding system of this invention.
Figure 2:
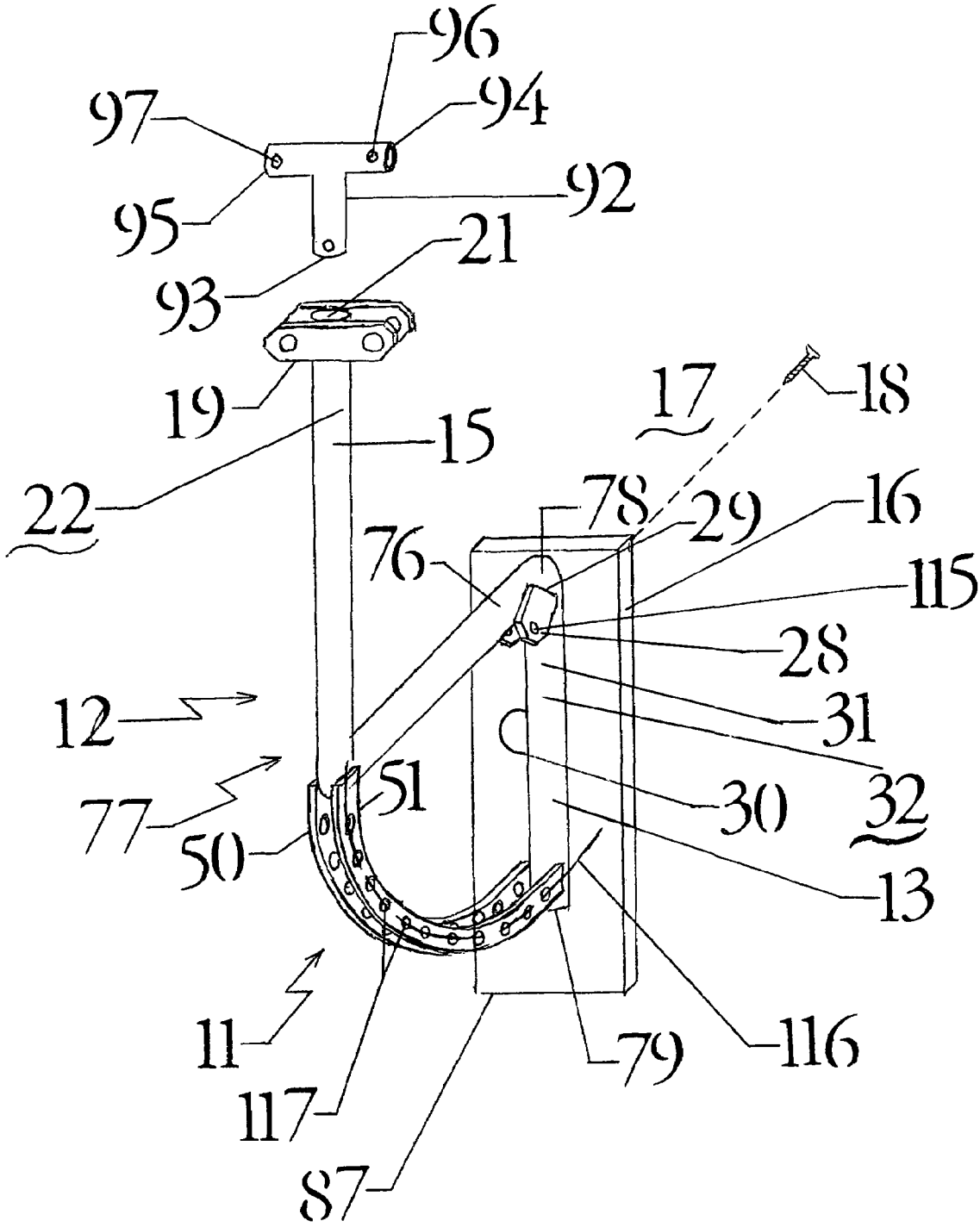
FIG. 2 is a greatly enlarged perspective view of one scaffolding bracket of the scaffolding system of FIG. 1.
Figure 3:
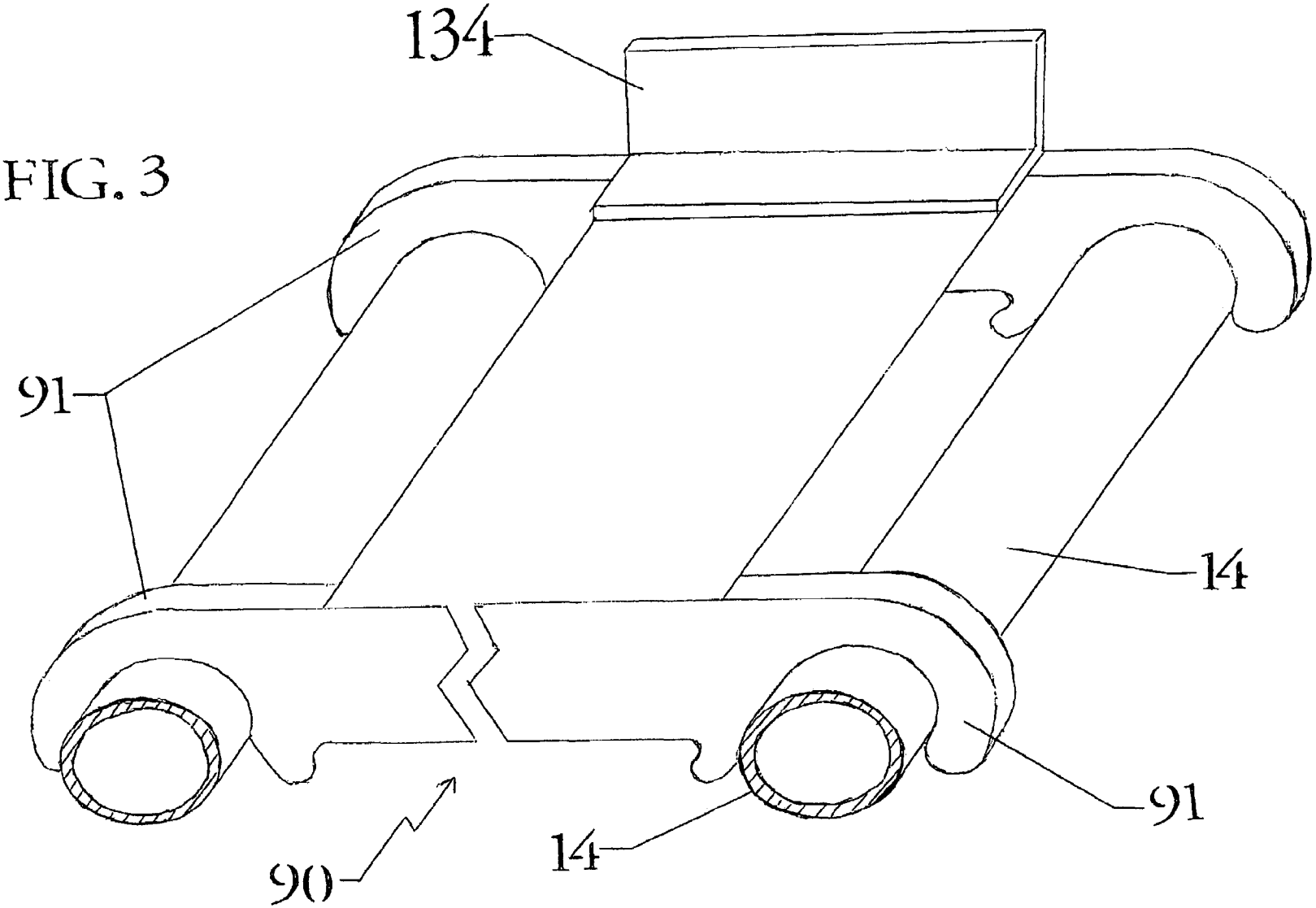
FIG. 3 is a perspective view of staging for the scaffolding system of the preferred embodiment of FIG. 1.

Referring now to FIGS. 1–9, the scaffolding system, generally shown with the number 10, comprises a plurality of scaffolding brackets 11 of FIG. 2 supported against a vertical wall 17 by a plurality of adjustable outriggers 23, when assembled together, scaffolding brackets 11 and associated adjustable outriggers 23 are hereinafter referred to as scaffolding units 99. Scaffolding brackets 11 comprise step-shaped supports 12 and damage preventing plate 16, each step-shaped support 12 comprising a downward leg 13, a walkway support 14 and an upright leg 15, downward leg 13, walkway support 14 and upright leg 15 joined together into an integral structure to thus comprise step-shaped support 12. Downward leg 13 has attached thereto a damage preventing plate 16 that is adapted to bear against wall 17 of a larger structure such as a building (not shown). Damage preventing plate 16 is affixed to downward leg 13 with screws, bolts or U-bolts through damage preventing plate 16, into, through or around downward leg 13, a sheet metal screw 18 preferred as sheet metal screw 18 may easily be driven through damage preventing plate 16 and directly threaded into the preferred thin-walled tubing of downward leg 13. Damage preventing plate 16 is preferably a 1×12 board approximately 4 feet in length thus providing sufficient surface area thereon to prevent damage to aluminum, plastic or wood siding affixed to wall 17. Step-shaped support 12 is preferably 2¼" automotive exhaust tubing which is readily bent into step-shaped 12 configuration shown in FIG. 1 using powered bending tools as are well known in the art. Furthermore, automotive exhaust tubing is relatively light in weight and thus each scaffolding bracket 11 may easily be transported by hand to a selected erection site from a small truck bed used to store and transport scaffolding system 10 from site to site. Upright leg 15 is adapted to receive safety rail 20 between a pair of connection plates 19 affixed to upper end 21 of upright leg 15, best shown in FIG. 8, both connection plates 19 extending beyond the outer periphery 22 of upright leg 15 in opposing directions sufficient distance to receive one of the open ends 24, 25 of opposed ends of telescoping safety rail 20 therein. An alternate method of connecting safety rails 20 to upright legs 15 is shown spaced above end 21 of scaffolding bracket 11 in FIG. 2 wherein a T-shaped receiver 92 has end 93 inserted into end 21 of upright leg 15 and has open ends 94, 95 which receive ends 24, 25 of safety rails 20 therein. Implement pins 43 are then passed through pairs of holes 96, 48 and 97, 47 respectively of T-shaped receiver 92 and safety rails 20. Walkway support 14 comprises an horizontal section between legs 13 and 15 and is adapted to receive the hooked ends 91 of a commercially available staging 90 thereupon generally depicted in FIG. 3, hooked ends 91 of staging 90 modified to be received over walkway support 14 of scaffolding bracket 11, hooked ends 91 providing additional structural support to scaffolding system 10, however, as safety rails 20 are affixed to each scaffolding bracket 11, sufficient structural support is already provided for scaffolding system 10 wherein the use of a plank 26 lying upon walkway support 14 is possible, plank 26 appearing in dashed lines on FIG. 1.

Scaffolding bracket 11 is supported above the working surface 27 and against wall 17 with adjustable outrigger 23 rotatably fixed to the apex 29 between downward leg 13 and walkway support 14, scaffolding bracket 11 and adjustable outrigger 23 comprising scaffolding unit 99. Apex 29 has a pair of attachment plates 28 affixed to the opposed side edges 30, 31 of outer periphery 32 of step-shaped support 12. Attachment plates 28 may span completely across apex 29 from downward leg 13 to walkway support 14, thus comprising a gusset 114, however, since attachment plates 28 are ¼" thick steel plates and apex 29 is a large radius curve formed in steel tubing, it is generally sufficient to attach attachment plates 28 to the center 33 of apex 29 by welding attachment plates 28 to outer periphery 32. Attachment plates 28 are provided with a through hole 34 adapted to receive a farm trailer pin 35 therethrough for attaching adjustable outrigger 23 therebetween, farm trailer pin 35 spaced from hole 34 in FIG. 7 and rotated 90 degrees to display a plan view thereof. As will become readily apparent, farm trailer pin 35 provides for rotational support of adjustable outrigger 23 when free end 36 of adjustable outrigger 23 is placed between attachment plates 28. Bearing hole 40 in free end 36 of adjustable outrigger 23 is aligned with hole 34 through attachment plates 28 wherein farm trailer pin 35 is passed through holes 34 and 40 and secured therein with a keeper 37 frictionally fit within a keeper hole 38 in end 39 of farm trailer pin 35. Farm trailer pin 35 is preferably a commercially available pin used for attaching farm implements to a three point hitch and therefore is readily available. Farm trailer pin 35 may also be used to affix opposed ends 24, 25 of telescoping safety guard rails 20 to ends 41, 42 of connection plates 19 respectively, however, it is preferred that an implement pin 43 be used for connecting telescoping safety guard rails 20 to connection plates 19 as implement pins 43 do not protrude far from side connection plates 19 and thus do not protrude into the working space between safety rails 20 and wall 17. Though it is preferred that farm trailer pins 35 and implement pins 43 be used to joined together the elements of scaffolding system 10 of this invention, it is within the scope of this invention to use depressible spring biased pins 122 inserted within the ends of the various units to facilitate assembly an adjustment of the units of scaffolding system 10.

Figure 5:
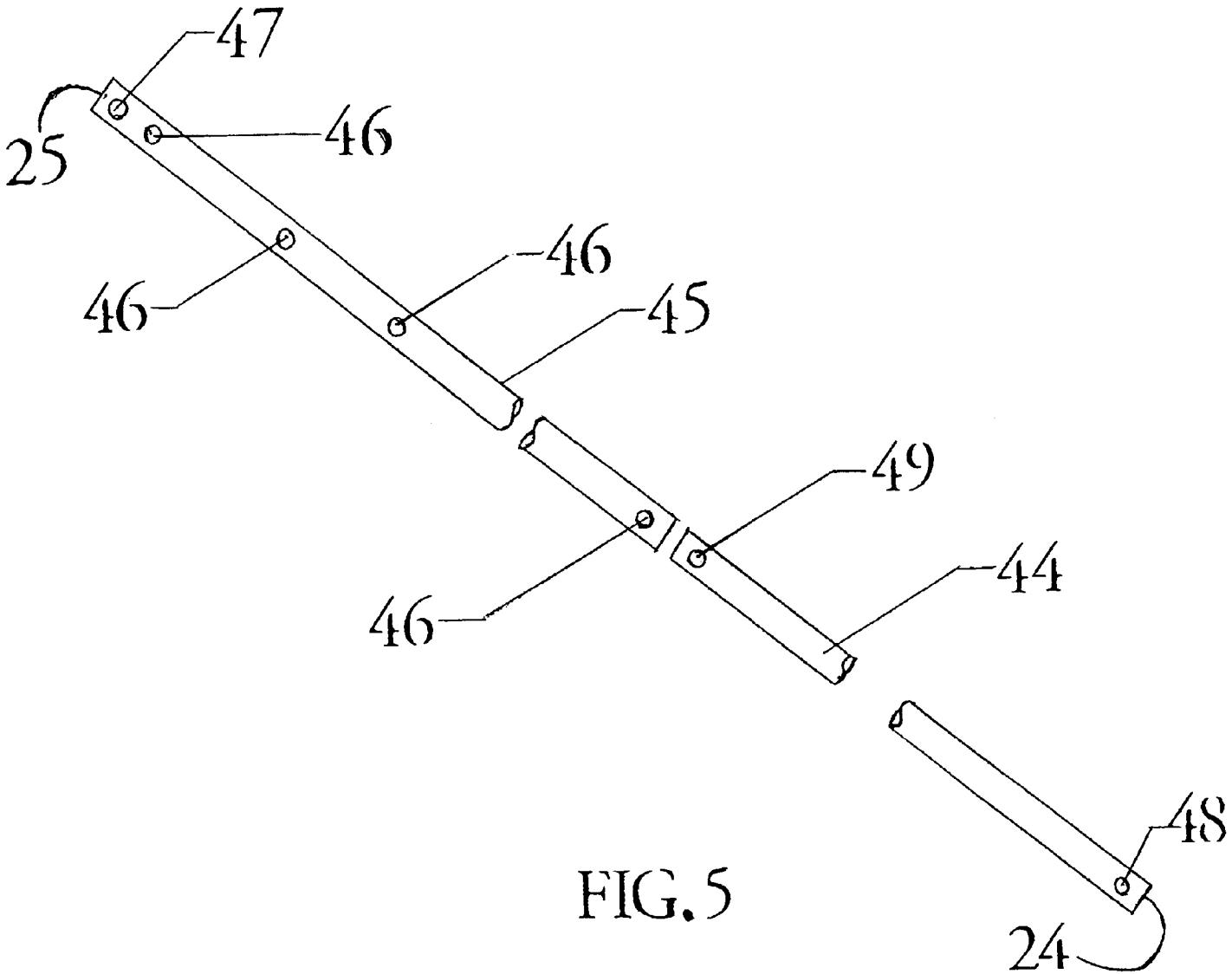
FIG. 5 is a partially exploded view of one of the telescoping safety rails used to space apart the preferred scaffolding brackets of FIG. 1 and to provide structural support to the scaffolding system of FIG. 1.

Safety guard rails 20 of FIG. 5 comprise at least two telescoping sections 44, 45 of interfitting size to slidably telescope while maintaining structural strength when joined together with implement pins 43. Telescoping sections 44, 45 are preferably interfitting sections of automotive exhaust tubing, section 44 provided with a connection hole 48 in end 24 and a staging length hole 49 through the end opposite end 24. Connection hole 48 is aligned with hole 52 in end 41 of connection plate 19 on upright leg 15 and receives implement pin 43 thereinto when safety guard rail 20 is fixed to upright leg 15. Staging length hole 49 receives another implement pin 43 therethrough when aligned with one of staging length holes 46 through outer telescoping section 45 when scaffolding unit 99 is raised into position against wall 17. Staging length holes 46 are preferably provided at one foot intervals along telescoping outer section 45 to allow scaffolding units 99 to be spaced at the proper distance for each length of staging 90 to be used between adjacent scaffolding units 99, however, staging length holes 46 may be arranged at other spacings as desired. Thus, one pair of scaffolding units 99 may be placed at a distance of 8 feet between walkway support 14 of the adjacent scaffolding units 99 while another adjacent pair of scaffolding units 99 may be spaced at a distance of 10 feet. Preferably, however, since scaffolding system 10 is intended for the small contractor or private homeowner such that scaffolding system 10 may be transported in the bed of a pickup truck, staging 90 are generally all 8 feet in length. Accordingly, safety guard rails 20 are adapted to be fixed at a length to space upright legs 15 substantially eight feet apart and therefore each of telescoping sections 44, 45 are approximately 7½ feet in length allowing for the length of connection plates 19. It should be apparent that an important feature of this invention is that safety guard rails 20, when pinned to each upright leg 15, become integral structural parts of scaffolding system 10 and therefore provide structural support to scaffolding system 10 as individual scaffolding units 99 are tied together thus overcoming one of the shortcomings of prior art angled support scaffolding brackets.

Scaffolding brackets 11 are generally spaced apart by safety rails 20 pinned to a distance equal to the length of staging 90 by pinning opposing ends 24, 25 of safety rails 20 to connecting plates 19 at end 21 of adjacent scaffolding brackets 11. Adjustable outriggers 23 are then assembled to each scaffolding bracket 11 by placing free end 36 of adjustable outrigger 23 between supporting side braces 50, 51 and affixing farm trailer pin 35 through holes 34 in attachment plates 28 and bearing hole 40 disposed in free end 36 of adjustable outrigger 23. Scaffolding brackets 11 have arcuate side braces 50, 51 associated therewith, acuate side braces 50, 51 having a plurality of aligned pinning holes 117 disposed therethrough on an arc 116, arc 116 having a center point 115 proximate apex 29 between downwardly extending leg 13 and integral walkway support 14, center point 115 substantially corresponding with hole 34 in attachment plates 28. Arcuate side braces 50, 51 and attachment plates 28 receive free end 36 of adjustable outrigger 23 therethrough, free end 36 pinned to attachment plates 28 with farm trailer pin 35 disposed through holes 34 in attachment plates 28 and hole 40 of the free end 36 of adjustable outrigger 23, adjustable outrigger 23 then pinned into one of a plurality of defined angular positions relative to scaffolding bracket 11 by placing another farm trailer pin 35 through a pair of aligned pinning holes 117 in arc 116 and through the one hole 54 in telescoping section 55 corresponding to the radius from center point 115 to arc 116. Only one pair of aligned pinning holes 117 receives farm trailer pin 35 therethrough when adjustable outrigger 23 is at the defined angular position, farm trailer pin 35 passing through one of arcuate side braces 50, 51, adjustable outrigger 23 and through the other of arcuate side braces 51, 50, farm trailer pin 35 retained in aligned pinning holes 117 with a keeper 37 disposed through the free end 36 thereof. Scaffolding system 10 can be assembled on the working surface 27 adjacent wall 17 and thereafter hoisted into position against wall 17 at the desired elevation by removing implement pin 43 from staging length holes 46, 49 and temporarily placing implement pin 43 into holding hole 53 disposed centrally through connecting plates 19. Prior to hoisting each scaffolding unit 99 into position, adjustable outriggers 23 are extended to the proper length to provide for angled support to each scaffolding bracket 11 by placing implement pin 43 through one of holes 54 in first telescoping section 55 aligned with one of holes 56 in second telescoping section 57 and through another one of holes 56 in second telescoping section 57 aligned with one of holes 58 in third telescoping section 59. Preferably, adjustable outrigger 23 should be placed at an angle of between 45 and 75 degrees from the horizontal in order to provide for upward support for individual scaffolding brackets 11, however, scaffolding system 10 has been supported against wall 17 with scaffolding brackets 11 substantially at working surface 27 thus placing adjustable outrigger 23 at an angle considerably less than 45 degrees. Since each of telescoping sections 55, 57 and 59 are approximately 8 feet in length in order to be safely transported in the bed of a standard pickup truck, the maximum extended length of adjustable outrigger 23 of three sections is approximately 23 feet and therefore can support scaffolding bracket 11 approximately 22 feet above working surface 27 at an angle of 75 degrees from the horizontal. It should be appreciated here, that although the recommended angle between adjustable outrigger 23 and working surface is preferred to be between 45 and 75 degrees any other angle may be used to support scaffolding bracket 11 against wall 17, however at angles below 45 degrees, a greater force is generated against wall 17 than is supported by adjustable outrigger 23 and at angles greater than 75 degrees there is a greatly decreased force against wall 17.

Figure 4:
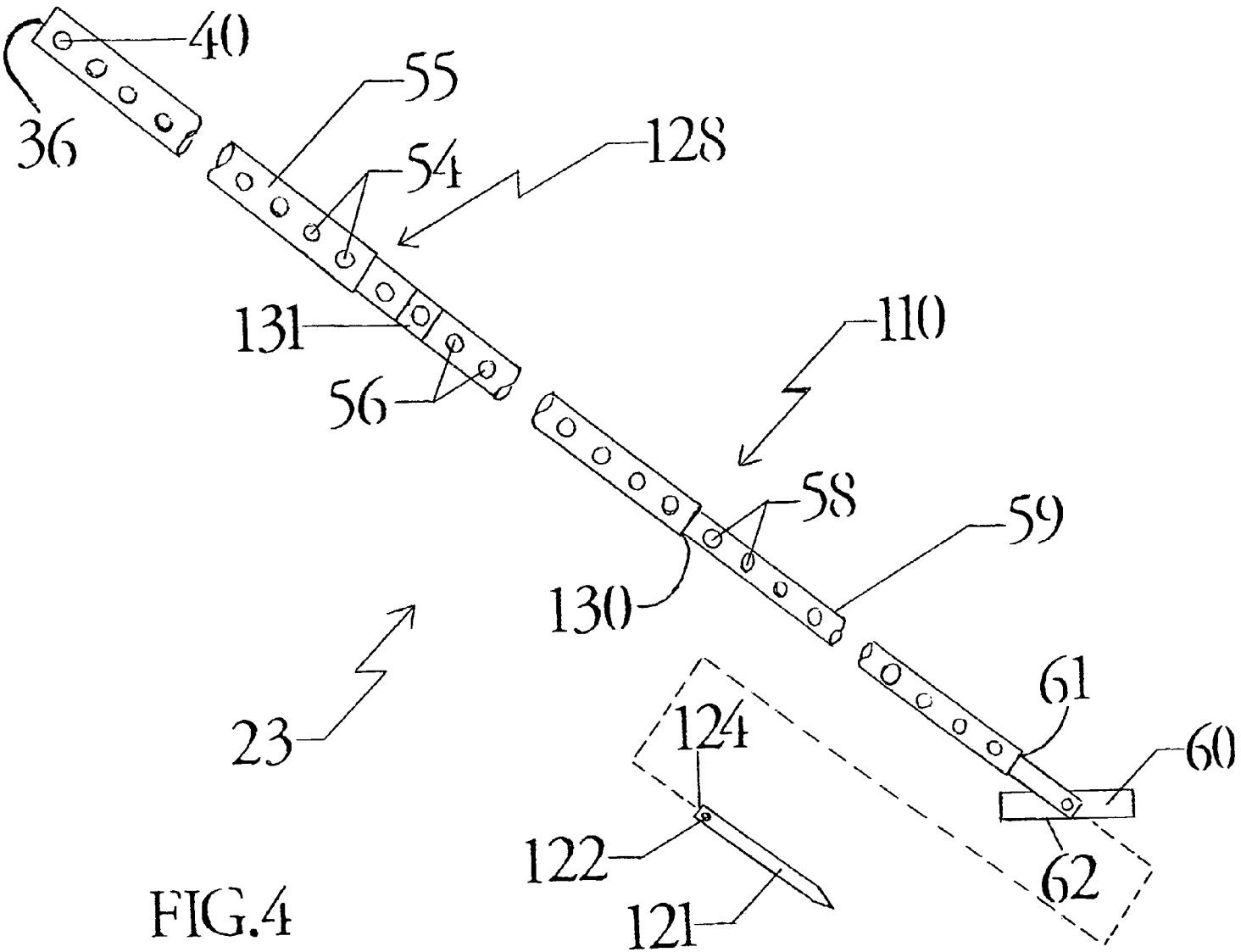
FIG. 4 is a partially exploded view of one of the adjustable outriggers used to support the preferred scaffolding bracket of FIG. 1 against a wall.

Adjustable outrigger 23 as shown in FIG. 4 preferably is also made of automotive exhaust tubing of at least three interfitting diameters and therefore first section 55 is preferably a 2½" diameter tube, center section 57 is preferably a 2¼" diameter tube and bottom section 59 is 2" in diameter. Of course, more sections of the same, smaller or larger diameter tubing may be used to elevate scaffolding brackets 11 to greater heights without departing from the scope of this invention. For instance, foot 60 may be removed from end 61 of adjustable outrigger 23 and a fourth section of the same diameter as center section 57 may be added to adjustable outrigger 23 and likewise a fifth section of the same diameter as first section 55 may be added thereto to extend adjustable outrigger 23 to a maximum length of 38 feet thus allowing support of scaffolding brackets 11 at a maximum working height of over 36 feet. Likewise, larger diameter tubing may be used for additional "n" sections support of scaffolding system 10 at greater heights. After assembling telescoping sections 55, 57, 59, . . . n, together to the desired length, foot 60 is reinstalled in the end of the lower most section such as end 61 of section 59. Foot 60 is preferably a commercially available ladder foot comprising a channel shaped member with a rubberized bottom surface 62 thus allowing adjustable outrigger 23 to be placed upon a finished floor surface as well as usable on substantially level working surface 27. Foot 60 may be selected from a group comprising the aforementioned articulated channel shaped member with a rubberized underside surface 125, an enlarged plate member 119 having spikes 120 on underside surface 125 thereof, a rectangular plate having at least one hole therethrough for receiving a stake therein, an enlarged spike 121 which may be withdrawn into the free end 61 of adjustable outrigger 23, enlarged plate member 119 having an open mesh 126 between the peripheral edges thereof or enlarged plate 19 having open mesh 126 between the peripheral edges thereof and spikes 120 protruding from underside surface 125 thereof wherein enlarged plate 119 may be reversed for use on the appropriate surface 27. Open mesh 126 may comprise expanded or perforated metal or the like to provide a "snowshoe" effect wherein enlarged plate 119 will rest upon a soft or shifting surface yet provide support for scaffolding system 10. Alternately, where scaffolding system 10 is desired to be used upon a working surface 27 of questionable stability, foot 60 may comprise an enlarged plate 119 having spikes 120 on an underside surface 125 thereof, spikes 120 adapted to penetrate into working surface 27 to assist in retaining adjustable outrigger 23 into a desired location while enlarged plate 119 permits use of scaffolding system 10 on shiftable material such as sand. Alternately, foot 60 may be an enlarged spike 121 which may be withdrawn into end 61 of lower most section 59, spike 121 shown alongside adjustable outrigger 23 in FIG. 4 with a dot-dash centerline showing placement within end 61. Preferably, spike 121 has at least one depressible spring biased pin 122 installed in the end 124 adapted to be engaged in end 61 of adjustable outrigger 23. As spike 121 has depressible spring biased pin 122 installed in end 124, spike 121 may be withdrawn into section 59 of adjustable outrigger 23 a sufficient distance so is not to interfere with foot 60 when foot 60 is desired to be used whether foot 60 comprises a commercially available ladder foot or enlarged plate 119. Enlarged plate 119 is shown disposed on end 61 of one adjustable outrigger 23 and spike 121 is shown on another adjustable outrigger 23 in FIG. 1.

Holes 54, 56 and 58 are provided at six inch intervals along the entire length of telescoping sections 55, 57 and 59 respectively in order to provide for support of scaffolding brackets 11 on an uneven working surface 27. As side plates 50, 51 having a plurality of aligned pinning holes 117 though of course, adjustable outrigger 23 of scaffolding units 99 may be placed at different angles with respect to working surface 27 without departing from the scope of this invention. The length of extension of adjustable members may easily be determined by adding the sum of the extensions of each of the sections to the length of section 55 as holes 56 and 58 are labeled with an amount of extension from juncture 118 between sections 57 and 59 and juncture 128 between sections 55 and 57. For instance, if the desired length of adjustable outrigger is 15 feet, each of lower sections 57, 59 may be extended out 7 holes (3.5 feet each)

when added to the 8 foot length of section 55 equals 15 feet, although, theoretically, the height of foot 60 must also be added in to the total. Labeling for the amount of extension is preferably done by marking every other hole 56, 58 with a broad band 131 of differing color material peripherally around sections 57, 59 spanning across the respective hole 56, 58 as shown below juncture 128 in FIG. 4. Inscribed in broad band 131 is the length extended from free end 130 of section 57.

Figure 6:
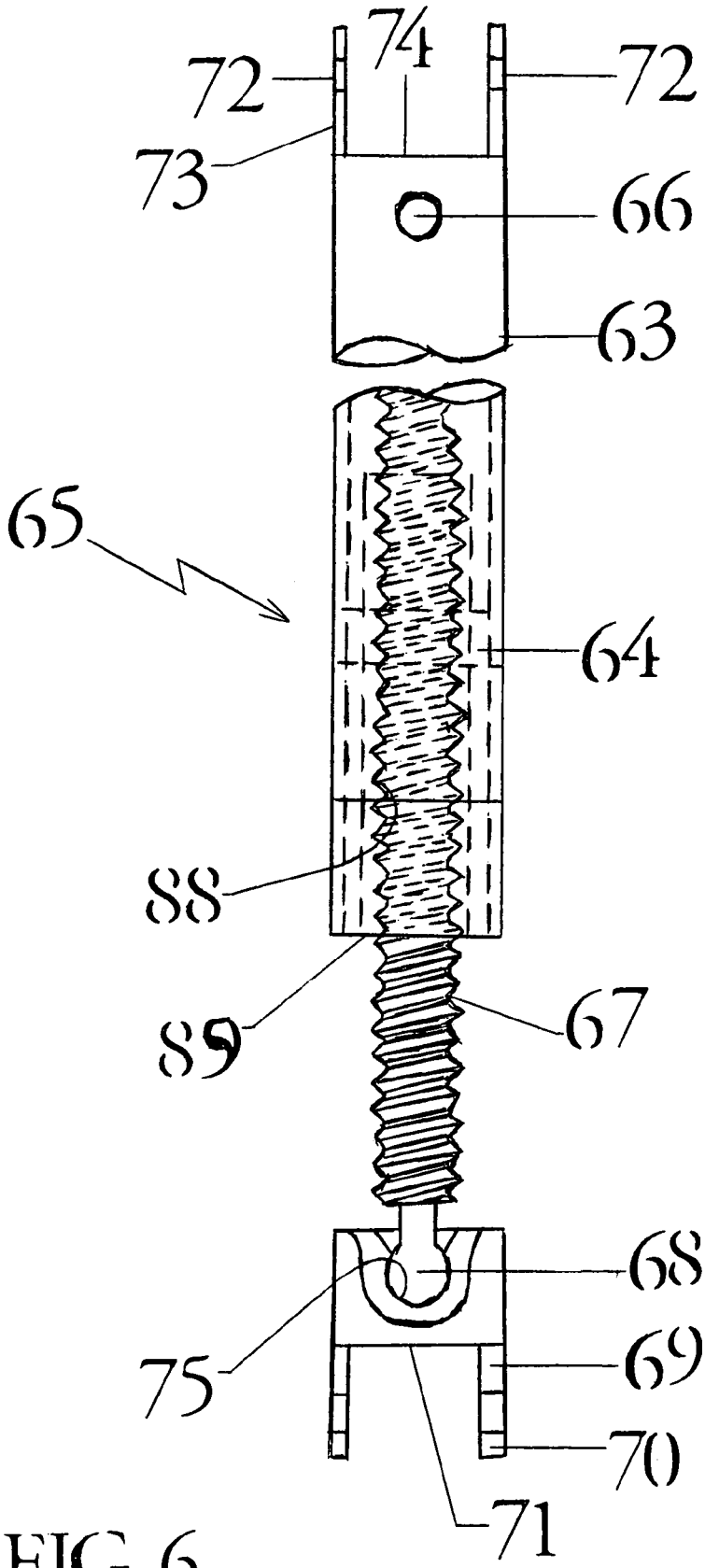
FIG. 6 is a view of the adjustable brace used to provide structural support to the scaffolding system of FIG. 2 having portions cut away to reveal internal structure.
Figure 7:
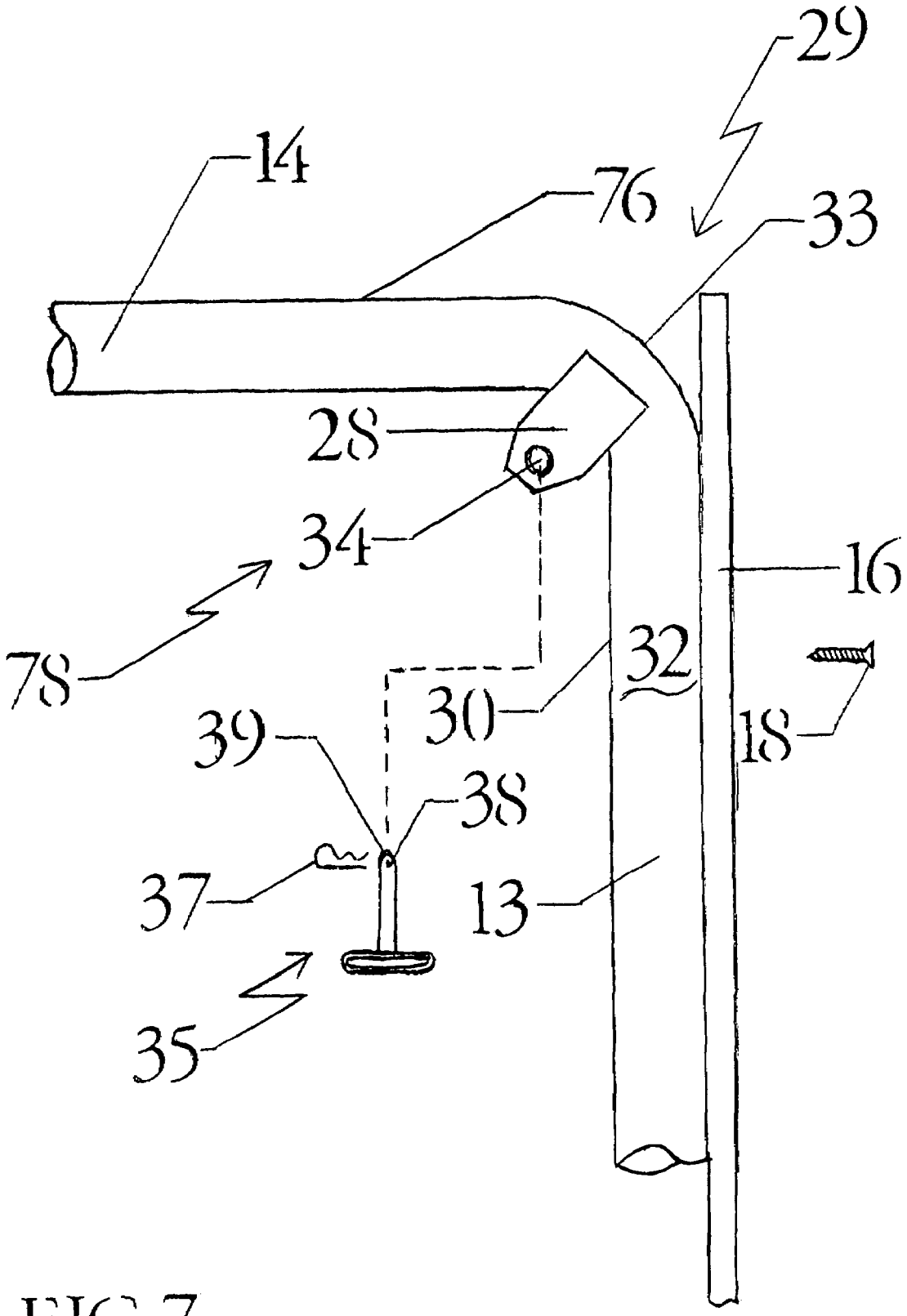
FIG. 7 is a greatly enlarged side plan view of an apex between a down leg and a walkway support leg of a step-shaped support of the scaffolding bracket of the scaffolding system of FIG. 1 showing attachment plates affixed adjacent the apex.
Figure 8:
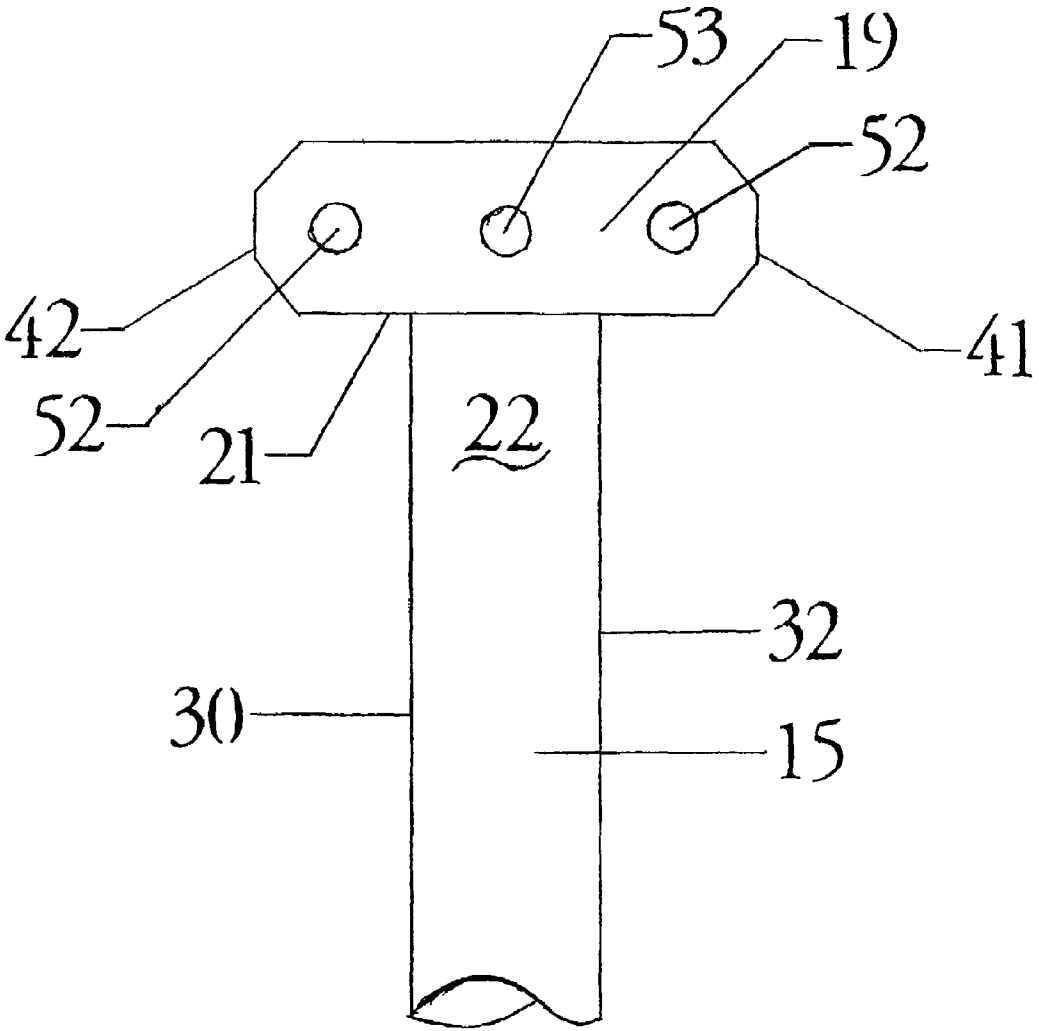
FIG. 8 is a greatly enlarged side plan view of the end of an upright leg of a step-shaped support of the scaffolding bracket of the scaffolding system of FIG. 1 showing connection plates affixed to the outer periphery thereof for receiving opposed ends of a safety guard rail therebetween.

An integral portion of the structural support of scaffolding system 10 of this invention is an angular cross brace 65 as shown in FIG. 6, angular cross brace 65 comprised of at least two telescoping sections 63 and 64 which are adapted to be pinned together through at least one hole 66 in section 63 and a corresponding hole (not shown) in section 64 and set to an exact length using a threaded shaft 67 threaded into a receiving thread 88 disposed internally in telescoping section 64. Telescoping section 63 has a yoke 73 disposed on end 74 thereof, yoke 73 having pin receiving holes 72 disposed through both arms thereof, holes 72 to be aligned with one of holes 54, 56 or 58 in one adjustable outrigger 23 during erection of scaffolding system 10. Threaded shaft 67 terminates in a ball 68 which is captured in a socket 75 disposed in a terminating block 71. Terminating block 71 has a yoke 69 extending therefrom, yoke 69 having through holes 70 in both arms thereof, holes 70 adapted to receive an implement pin 43 therethrough after aligning holes 70 with one hole 58, 56 or 54 in an adjacent adjustable outrigger 23. Another angular cross brace 65 may be affixed between other adjacent adjustable outriggers 23, however, it has been found that only one angular cross brace 65 is generally needed for scaffolding system 10. Generally, holes 72 in section 63 are first aligned with one of holes 54 in first section 55 of adjustable outrigger 23 and implement pin 43 passed therethrough to attach angular cross brace 65 to adjustable outrigger 23 of one scaffolding unit 99. When raising a first one of scaffolding units 99 to the desired elevation, angular cross brace 65 is retained with an implement pin 43 through holes 72 in yoke 73 and one hole 54 near free end 36 of adjustable outrigger 23 with angular cross brace 65 extending externally of scaffolding system 10 having a foot 60 affixed to yoke 69 through holes 70, foot 60 resting upon working surface 27 such that the scaffolding unit 99 being elevated may be safely elevated to the desired position on wall 17 as angular cross brace 65 will provide lateral support to adjustable outrigger 23 while raising scaffolding unit 99. After at least the adjacent scaffolding unit 99 is elevated to the desired position against wall 17, angular cross brace 65 has foot 60 removed from yoke 69 and angular cross brace 65 is extended to an approximate position over the adjacent adjustable outrigger 23. Holes 70 are then aligned with one of holes 58 in the adjacent adjustable outrigger 23, preferably near end 61, by adjusting the position of yoke 69 using threaded shaft 67. When holes 70 are aligned with one of holes 58, implement pin 43 is passed therethrough thereby pinning two adjacent adjustable outriggers 23 together. By pinning two adjacent adjustable outriggers 23 together, lateral support to adjacent scaffolding units 99 supported by these two adjacent adjustable outriggers 23 is provided. Since all scaffolding units 99 of scaffolding system 10 are tied together through safety rails 20, lateral support is provided to all of scaffolding system 10 and a side force on any one of scaffolding brackets 11 is transmitted to the adjacent scaffolding unit 99 and therefore the effect of the side force is distributed to all scaffolding unit 99, adjustable outriggers 23 and angular cross brace 65. Angular cross brace 65 is also preferably made of automotive exhaust tubing wherein section 63 is preferably 2½" in diameter and section 64 is preferably 2¼" in diameter. Section 63 has yoke 73 formed thereon by welding the side pieces of yoke 73 alongside tubing section 63 or may be formed from the sidewalls of section 63. Section 64 has receiving thread 88 disposed in end 89 thereof wherein receiving thread 88 may comprise a nut of a proper thread diameter welded onto end 89. Angular cross brace 65 may be extended by providing another section of automotive exhaust tubing having pin receiving holes 66 in the opposed ends thereof in the same manner as sections 55, 57 or 59 of adjustable outrigger 23.

Step-shaped support 12 is preferably formed from 2½" diameter automotive exhaust tubing having a 6" radius, 90 degree curve 77 formed approximately 31 inches from one end 21 followed by a 10" straight walkway support 14. At the end 76 of walkway support 14, another 6" radius, 90 degree curve 78 is formed in a direction opposite curve 77, curve 78 followed by straight downward leg section 13 of approximately 28 inches thus forming step-shaped support 12 as an integral unit. Support braces 50, 51 are then affixed to outer surfaces 30, 31 of outer periphery of downward leg 13 adjacent the bottom end 79 thereof, support braces 50, 51 affixed to outer surfaces 30, 31 of curve 77 thus providing additional support to walkway support 14. As support braces 50, 51 are spaced apart by a distance equal to the outside dimension of step-shaped support 12, support braces 50, 51 are also spaced apart a distance at least equal to the outside diameter of first section 55 of adjustable outrigger 23, support braces 50, 51 lending guidance to adjustable outrigger 23. Apex 29 formed by curve 78 has attachment plates 28 affixed to opposed side edges 30, 31 of outer periphery 32 of step-shaped support 12 and are adapted to receive free end 36 of adjustable outrigger 23 therebetween. Attachment plates 28 have ½" diameter farm trailer pin receiving holes 34 drilled therethrough for receiving farm trailer pin 35 therein, holes 34 spaced from the inside surface of curve 78 about 1 inch to allow for free movement of free end 36 of adjustable outrigger 23 when pinned to attachment plates 28. Connection plates 19 are affixed to outer periphery 22 on opposite sides of upper end 21 of upright leg 15, connection plates 19 extending equally from opposing sides 30, 31 of step-shaped support 12. Connection plates 19 have 0.400 inch holes 52 drilled through both ends 41, 42 thereof, holes 52 spaced from opposing side edges 30, 31 of upright leg 15 to allow for installation of safety guard rails 20. Holes 52 are sized to receive implement pin 43 therein when ends 24, 25 of safety rails 20 are aligned therewith at erection of scaffolding system 10. In the preferred embodiment, support braces 50, 51, attachment plates 28 and connection plates 19 are preferably quarter inch thick steel flat stock that is welded to the locations hereinbefore described, however, it is fully understood that other materials may be used to advantage. For instance, it is fully within the scope of this invention to construct step-shaped support 12, telescoping outrigger sections 55, 57, 59, safety rail sections 44, 45 and end safety rail section 80 be of aluminum tubing and affixing aluminum support braces 50, 51 attachment plates 28 and connection plates 19 thereto. Though round tubing has been heretofore specified for step-shaped support 12, telescoping outrigger sections 55, 57, 59, safety rail sections 44, 45 and end safety rail section 80, it is within the scope of this invention to substitute materials of other cross section, such as polygonal or elliptical. Of course, it is also within the scope of this invention to construct all of the parts hereof of other materials or a combination of materials including but not limited to wood, metals or thermoplastics.

Safety guard rails 20 of FIG. 5 are formed from at least two telescoping sections 44, 45 of automotive exhaust tubing of interfitting size to slidably telescope while maintaining structural strength. Telescoping section 44 is preferably 1½" diameter exhaust tubing which readily telescopes into section 45 which is preferably 1¾" diameter tubing. Section 44 has a 0.400" diameter connection hole 48 drilled through end 24 approximately 1 inch from end 24 and has a similar sized staging length hole 49 drilled through the end 25 opposite end 24. Likewise, section 45 has a 0.400" diameter connection hole 47 drilled approximately one inch from end 25, connection hole 47 to be aligned with hole 52 in end 41 of connection plates 19 and receive an implement pin 43 therethrough at erection of scaffolding system 10. Connection hole 48 is aligned with hole 52 in end 41 of connection plate 19 on upright leg 15 and receives implement pin 43 thereinto thus fixing end 24 of safety guard rail 20 to upright leg 15. A plurality of 0.400" diameter staging length holes 46 are drilled at one foot intervals through at least section 45 and are adapted to receive another implement pin 43 therethrough when aligned with staging length hole 49 in section 44 when scaffolding unit 99 is raised into position against wall 17 thus fixing two adjacent scaffolding units 99 together at ends 21 of upright legs 15 providing structural support to scaffolding system 10. As staging length holes 46 are provided at one foot intervals along telescoping outer section 45, scaffolding units 99 can therefore be spaced at the proper distance for each length of staging 90 to be used between adjacent scaffolding units 99.

Figure 9:
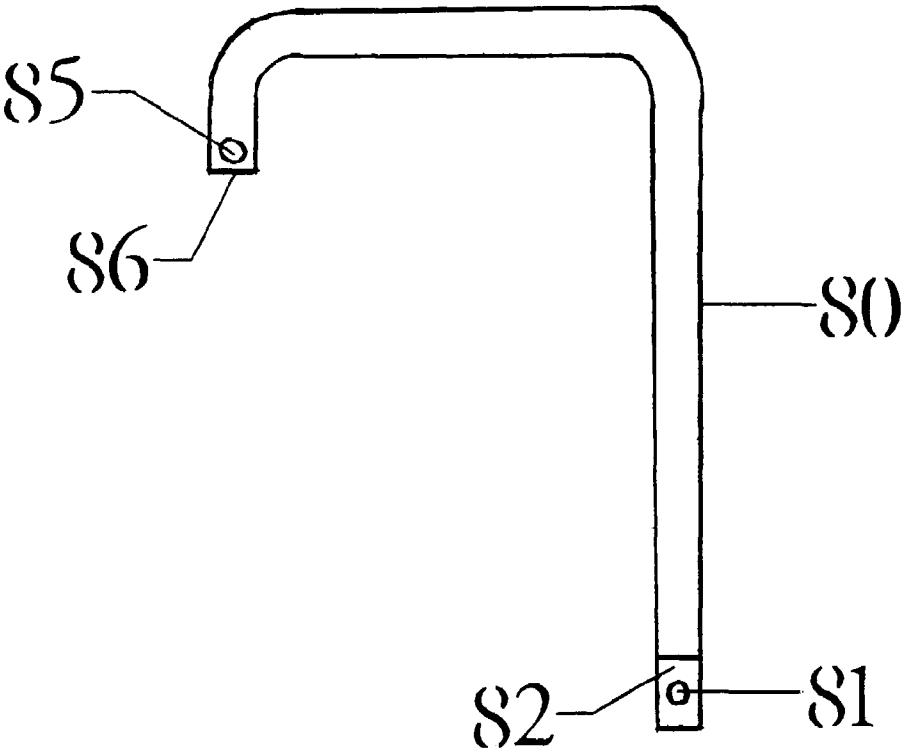
FIG. 9 is an enlarged side plan view of an end safety rail for the scaffolding system of FIG. 1.

End support safety rails 80 may be provided at ends 83, 84 of scaffolding system 10, end support safety rails 80 preferably also formed of 2¼" automotive exhaust tubing. As shown in FIG. 9 for the embodiment of FIG. 1, end safety rails 80 each have a yoke 82 at the lower end thereof which fits over walkway support 14 adjacent attachment plates 28 and receives implement pin 43 through hole 81 in yoke 82. Additionally, implement pin 43 is placed through hole 85 of upper end 86 of end safety rail 80, implement pin 43 also pinned through open hole 52 in connection plate 19 of the last of scaffolding units 99 in scaffolding system 10. Therefore, another measure of safety is provided to work persons using scaffolding system 10.

Depressible spring biased pins 122 may be internally disposed into telescoping sections 57 and 59 into one of holes 56 and 58, preferably near one end thereof, to fix a defined support angle of adjustable outrigger 23 when scaffolding brackets 11 are raised into position above working surface 27. Additionally, by using depressible spring biased pins 122 in holes 48, 49 of safety rail section 44 and hole 47 of safety rail section 45, erection of scaffolding system 10 may proceed rapidly as the distance between adjacent scaffolding unit 99 is automatically set when the depressible spring biased pin 122 in staging length hole 49 protrudes through staging length hole 46 in section 45. It is understood here that depressible spring biased pin 122 in hole 47 of section 45 protrudes through hole 52 in of connection plates 19 of one scaffolding unit 99 and depressible spring biased pin 122 in holes 48 of section 44 protrudes through hole 52 in connection plates 19 of the adjacent scaffolding unit 99, safety rail 20 having been preassembled thereto prior to raising either scaffolding unit 99. If it is desired to raise scaffolding units 99 to greater heights, it is only necessary to raise successive scaffolding units 99 to a position slightly less than the heights of the preceding raised scaffolding unit 99 such that depressible spring biased pin 122 in staging length hole 49 does not protrude through staging length hole 46 in section 45 until all scaffolding unit 99 are at the desired height. By raising each successive scaffolding unit 99 to a slightly lesser height than the preceding scaffolding unit 99, sections 44 and 45 of safety rails 20 remain free to telescope thus allowing each scaffolding unit 99 is raised directly vertically.

Scaffolding system 10 of this invention comprising a plurality of scaffolding brackets 11, a plurality of adjustable outriggers 23, a plurality of staging 90, a plurality of safety rails 20 and at least one angular cross brace 65, plurality of adjustable outrigger 23 supporting scaffolding brackets 11 against wall 17 with plurality of staging 90 spanning between scaffolding brackets 11 thus overcoming the limitations of prior art angled prop supported scaffolding systems by providing structural integrity to entire scaffolding system. Structural integrity is first achieved as each scaffolding bracket 11 is a single piece comprising a downwardly extending wall leg 13 rigidly affixed to one end 76 of an horizontally disposed walkway support 14 and an upwardly extending guard rail leg 15 rigidly affixed to the end opposite end 76 of horizontally disposed walkway support 14, wall downward leg 13 and walkway support 14 having a gusset 114 formed therebetween for attaching free end 36 of one adjustable outrigger 23 thereupon. Attachment plates 28 and side braces 50, 51 are spaced apart as shown in the figures, however, attachment plates 28 and side braces 50, 51 may be joined together to comprise a solid gusset 114, gusset 114 comprises a curved outer peripheral arcuate strut 129 with a center point 115 proximate the apex 29 between downwardly extending leg 13 and integral walkway support 14, curved outer peripheral arcuate strut 129 comprising a pair of arcuate members 50, 51 spaced apart a distance equal to the outside dimension of downwardly extending leg 13 of scaffolding bracket 11. Additional structural support is achieved by providing angular cross brace 65 between at least two adjustable outriggers 23 thus tying adjustable outrigger 23 of at least one scaffolding unit 99 near scaffolding bracket 11 to support end 61 of adjustable outrigger 23 of an adjacent scaffolding unit 99. Further structural support is achieved by fitting hooked ends 91 of staging 90 over the substantially horizontal walkway support 14 of adjacent step-shaped supports 12 spaced apart an exact distance by safety rails 20. Staging 90 may be as described in the aforementioned patent to Grover, et al., U.S. Pat. No. 2,997,767 or the aforementioned patent to Wallther, U.S. Pat. No. 6,530,456 B1, these patents incorporated by reference herein, but staging 90 is preferably constructed from expanded metal enclosed peripherally with a frame, the frame having hooks upon both ends thereof for placement over walkway supports 14. The frame of staging 90 preferably has kick plates 134 protruding upwardly therefrom arranged on at least one side edge of staging 90 as required by federal and state safety regulations.

With specific reference to FIG. 1, when a force $F_0$ is applied against safety rail 20 such as a work person misstepping on staging 90, $F_0$ is resolved into components $F_1$ and $F_2$ in opposite directions along safety rail 20. In the instant invention, safety rails 20 are integrally bound to upright legs 15 of adjacent step-shaped supports 12 and thus $F_1$ is transmitted in part, as shown by $F_3$, downwardly to working surface 27 along adjustable outrigger 23 and $F_2$ is likewise transmitted downwardly in part by $F_4$ to working surface 27 along adjacent adjustable outrigger 23. An additional portion of $F_2$ is transmitted along angular cross brace 65 to working surface 27 as $F_5$ and thus $F_0$ is fully resolved within scaffolding system 10. Thus, a plank 26 may be used as staging 90 though it is preferable to provide additional structural support to scaffolding system 10 by also hooking ends 91 of staging 90 over walkway supports 14 also transmitting some of the force laterally along staging 90. In the same manner as force $F_0$ is resolved internally within scaffolding system 10, a force $F_6$ against an end safety rail 80 may also be resolved as force $F_6$ is transmitted at least along safety rails 20 to adjacent upright legs 15 downwardly therethrough to adjustable outriggers 23 and angular cross brace 65.

Scaffolding system 10 is readied for lifting upwardly along wall surface 17 by first arranging all of scaffolding brackets 11 along wall 17 with bottom end 87 thereof resting upon working surface 27. Scaffolding brackets 11 are spaced apart by assembling ends 24, 25 of safety rails 20 to open ends 41, 42 of connection plates 19 on each upright leg 15 of scaffolding brackets 11 with implement pins 43 through each pair of holes 48/52 and 47/52 through ends 24/42 and 25/41, respectively. As safety rails 20 may be pinned exactly to a length of staging 90 to be used by placing implement pin 43 through staging length hole 49 of telescoping section 44 and a correct one of staging length holes 46 in telescoping section 45, scaffolding brackets 11 may be spaced at the desired distance. After placing each of scaffolding brackets 11 at the exact distance desired for the corresponding staging 90, implement pin 43 is removed from staging length holes 46, 49 and placed in holding hole 53 so that telescoping sections 44, 45 may move relative to each other while raising scaffolding brackets 11 in turn one at a time. Adjustable outriggers 23 are then pinned to attachment plates 28 by first passing free end 36 of adjustable outriggers 23 between side braces 50, 51 in each of scaffolding brackets 11 aligning hole 40 with hole 34 in attachment plates 28. Farm trailer pin 35 is then placed therethrough and has keeper 37 inserted into keeper hole 38 in the end 39 thereof thus rotatably fixing each adjustable outrigger 23 to each scaffolding bracket 11 and therefore establishing scaffolding unit 99. Preferably, angular cross brace 65 is then affixed to a hole 54 in upper section 55 of adjustable outrigger 23 in the end scaffolding unit 99 of scaffolding system 10 with screw yoke 69 initially allowed to move with adjustable outrigger 23. End safety rail 80 preferably has end 86 inserted into open end 21 of end scaffolding bracket 11 as shown in FIG. 1 or may be alternately shaped and assembled to open end hole 52 of connection plate 19 in end scaffolding bracket 11 as shown in dashed lines in FIG. 1. Once all scaffolding units 99 are assembled together on working surface 27 with damage preventing plates 16 resting against wall 17, end scaffolding unit 99 is elevated to the desired position by lifting scaffolding bracket 11 of scaffolding unit 99 upwardly along wall surface 17. Adjustable outrigger 23 is pulled inwardly along working surface 27 with foot 60 sliding along working surface 27 until the upward force of lifting is removed from scaffolding bracket 11 of the first, or end scaffolding unit 99. Foot 60 then supports scaffolding unit 99 against wall surface 17. It is fully understood here that telescoping safety rail sections 44, 45 move relative to each other between the first scaffolding unit 99 being raised and the next subsequent scaffolding unit 99 still resting upon working surface 27. Preferably, if scaffolding system 10 is to be raised to a height wherein the hypotenuse length between ends 21 of upright legs 15 exceeds the length of the some of telescoping sections 44, 45, each scaffolding unit 99 of scaffolding system 10 is raised in increments by successively elevating scaffolding units 99 to a given level and thereafter raising each scaffolding unit 99 in turn to the next increment. After raising end scaffolding unit 99 to the desired height, adjacent scaffolding unit 99 is raised to the desired height which may be readily determined by noting when the desired staging length hole 46 aligns with staging length hole 49 in telescoping safety rail section 44. After all scaffolding units 99 are raised to the desired height with staging length holes 49 aligned with the desired staging length hole 46, implement pins 43 are removed from holding holes 53 and placed through staging length hole pairs 46, 49 in telescoping sections 45, 44, respectively, of safety rail 20. Staging 90 may then easily be placed upon walkway supports 14 of adjacent scaffolding units 99 as walkway supports 14 of scaffolding units 99 are exactly spaced to receive hooked ends 91 of staging 90 thereover.

In another embodiment shown in FIGS. 10–13, scaffolding system 10 may be made a freestanding scaffolding system which comprises two opposed tripod end members 101 spaced apart by and joined together with at least one staging platform 90 a pair of end safety rails 80 and a pair of safety rails 20. Tripod end members 101 comprise two scaffolding units 99 having downwardly extending wall downward legs 13 joined together in an opposed relationship and a tripod outrigger 123, each scaffolding unit 99 carrying therewith its associated adjustable outrigger 23 rotatably supported in gusset 114 formed between downwardly extending leg 13 and integral walkway support 14. Tripod end member 101 then has tripod outrigger 123 rotatably supported between a pair of standoffs 113 in a upper coupling member 110, upper coupling member 110 joining downwardly extending downward legs 13 of scaffolding units 99 together adjacent apex 29 and further has lower clamping member 102 joining bottom ends 79 of downward legs 13 together. In the freestanding embodiment of FIGS. 10–13, damage preventing plates 16 are preferably removed from downward legs 13, however downward legs 13 may be joined together using damage preventing plates 16 to construct tripod end member 101 by affixing damage preventing plates together. Tripod outrigger 123 may be constructed from angular cross brace 65 by rotatably supporting foot 60 in yoke 69 and disposing open yoke 73 between standoffs 113 in upper coupling member 110, however, tripod outrigger 123 preferably is substantially equivalent to adjustable outriggers 23 associated with scaffolding units 99. Where one tripod end member 101 is erected on substantially a level working surface 27, the defined angular position of the adjustable outrigger 23 of one scaffolding unit 99 is substantially equal to the defined angular position of the adjustable outrigger 23 of the other scaffolding unit 99, however, where tripod end member 101 is erected on an uneven surface it is often necessary that the defined angular position of adjustable outrigger 23 of one scaffolding unit 99 be different than the defined angular position of the adjustable outrigger 23 of the other scaffolding unit 99.

Freestanding scaffolding system 100 preferably has scaffolding units 99 disposed in a substantially vertical plane when tripod end member 101 is raised to a standing position with tripod outrigger 123 extending downwardly from coupling member 110 in a plane perpendicular to the plane of scaffolding units 99. Integral walkway support 14 of scaffolding units 99 is thereby disposed in a substantially horizontal position by adjusting at least one of adjustable outriggers 23 and retained in a substantially vertical plane by tripod outrigger 123. Adjustable outriggers 23 and tripod outrigger 123 are preferably retained in the desired position by a chain 127 releasably captured on an implement pin 43 placed through one of holes 58 in lowermost section 59 adjacent juncture 118 of lowermost section 59 and section 57 of each of adjustable outriggers 23 and tripod outrigger 123. Alternately, a chain hook (not shown) may be provided on center section 57 adjacent juncture 118 for attaching individual links of chain 127 thereto to retain outriggers 23 and tripod outrigger 123 in the established triangular relationship.

Two scaffolding units 99 are joined together into tripod end member 101 by first disposing two step-shaped supports 12 arranged in opposing relationship wherein downward legs 13 are substantially contiguous. Center piece 103 of lower joining clamp 102 and center piece 111 of the upper coupling member 110 are then placed between downward legs 13 of the opposed step-shaped supports 12 and thereafter bolts 106 rigidly affixed to a first clamp half 104 of lower joining clamp 102 are disposed through matched drilled holes in bottom end 79 of one step-shaped support 12, through a center piece 103 and thereafter through matched drilled holes in bottom end 79 of a second step-shaped support 12. Thereafter, a second clamping half 105 is fitted over the ends of bolts 106 and nuts 107 are tightly threaded upon the open ends of bolts 106. In like manner, bolts 106 of another first clamp half 104 are passed through matched drilled holes adjacent the beginning of the curvature at apex 29 in downward leg 13, through upper center piece 111 through additional matched drilled holes in the opposed to step-shaped support 12 and likewise have nuts 107 firmly threaded upon the ends of bolts 106 thus joining to scaffolding units 99 together. Center piece 111 has a pair of standoffs 113 protruding outwardly from one side face 112 of center piece 111, standoffs 113 having pivot holes 117 disposed transversely therethrough for accepting farm trailer pin 35 therein at assembly of adjustable outrigger 123 thereto. Center piece 103 and center piece 111 each have a pair of internal cusps 108 formed thereon to allow downward legs 13 of step-shaped supports 12 to be joined together in a substantially contiguous manner. Though a pair of bolts 106 may be used in both lower joining clamp 102 to an upper coupling member 110, a single bolt 106 may be used in either clamping member 102, 110 without departing from the scope of this invention. Likewise, a commercially available load binding clamp may be firmly affixed to center piece 103 and/or center piece 111 with a chain link affixed to first clamp half 104 and second clamp half 105 wherein clamping members 102, 110 may be quickly assembled by arranging the pieces as hereinbefore described and closing the binding clamp. Additionally, a first clamp half 104 and a second clamp half 105 may be hinged to each of center piece 103 and center piece 111 on one side face 112 thereof to facilitate assembly with the commercially available load binding clamp affixed to the opposite side face (not shown) of center piece 103, 111 respectively. Preferably, clamp halves 104 and 105 are sections of automotive exhaust tubing having an internal curvature 109 substantially equal to the outside diameter of step-shaped support 12, first clamp half 104 having bolt 106 disposed therethrough and welded thereto and clamp half 105 has a hole (not shown) disposed therethrough for receiving the bolt 106. Center piece 103 is preferably also a split section of automotive exhaust tubing having metal side faces welded to the ends of the split section therefore providing outwardly facing internal cusps 108. It is within the scope of this invention, however, to mold or cast center pieces 103, 111 from a thermoplastic or metallic material or to machine same from a machinable material such as wood. Likewise, clamp halves 104 and 105 may be produced from alternate materials.

Figure 13:
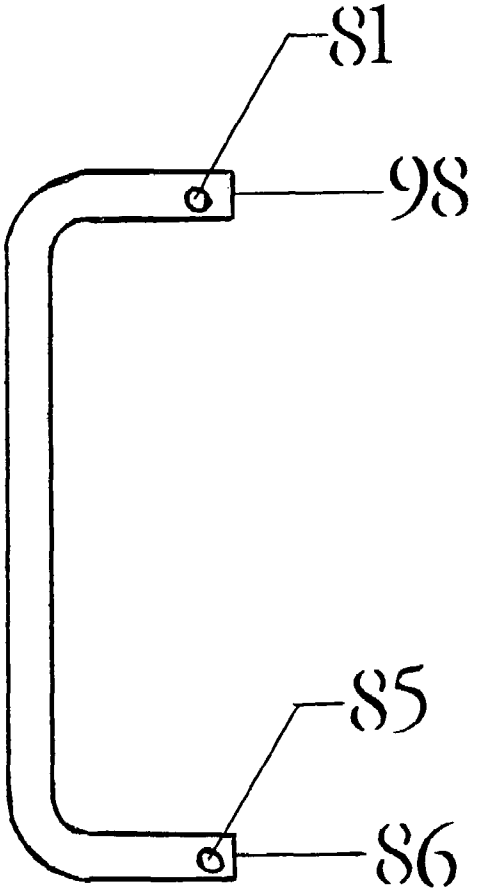
FIG. 13 is a side plan view of an end safety rail for the scaffolding system of FIG. 10.
Figure 10:
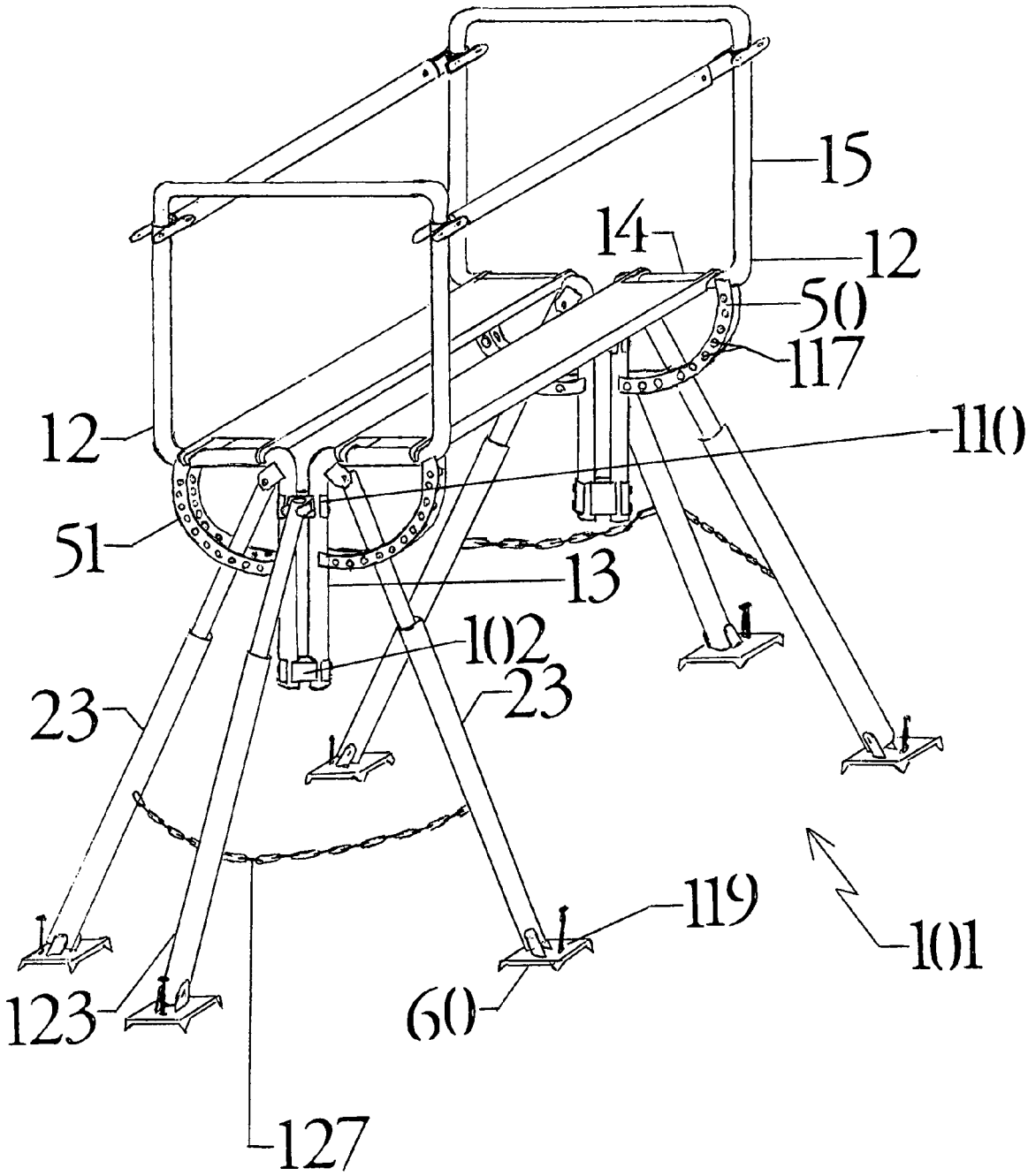
FIG. 10 is a perspective view of a freestanding embodiment of the scaffolding system of this invention.
Figure 11:
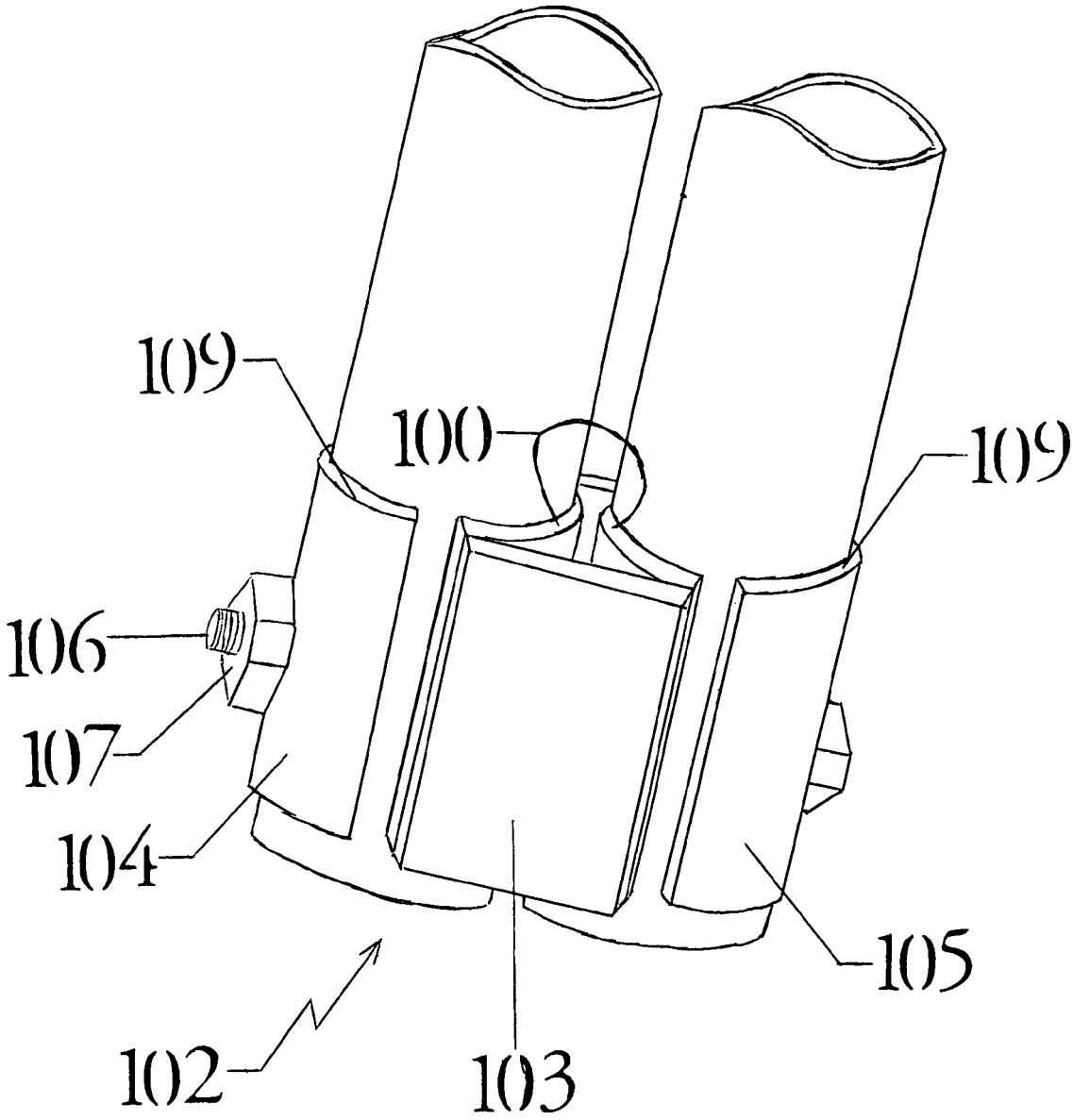
FIG. 11 is a greatly enlarged view of a lower clamp of the end member of FIG. 10.
Figure 12:
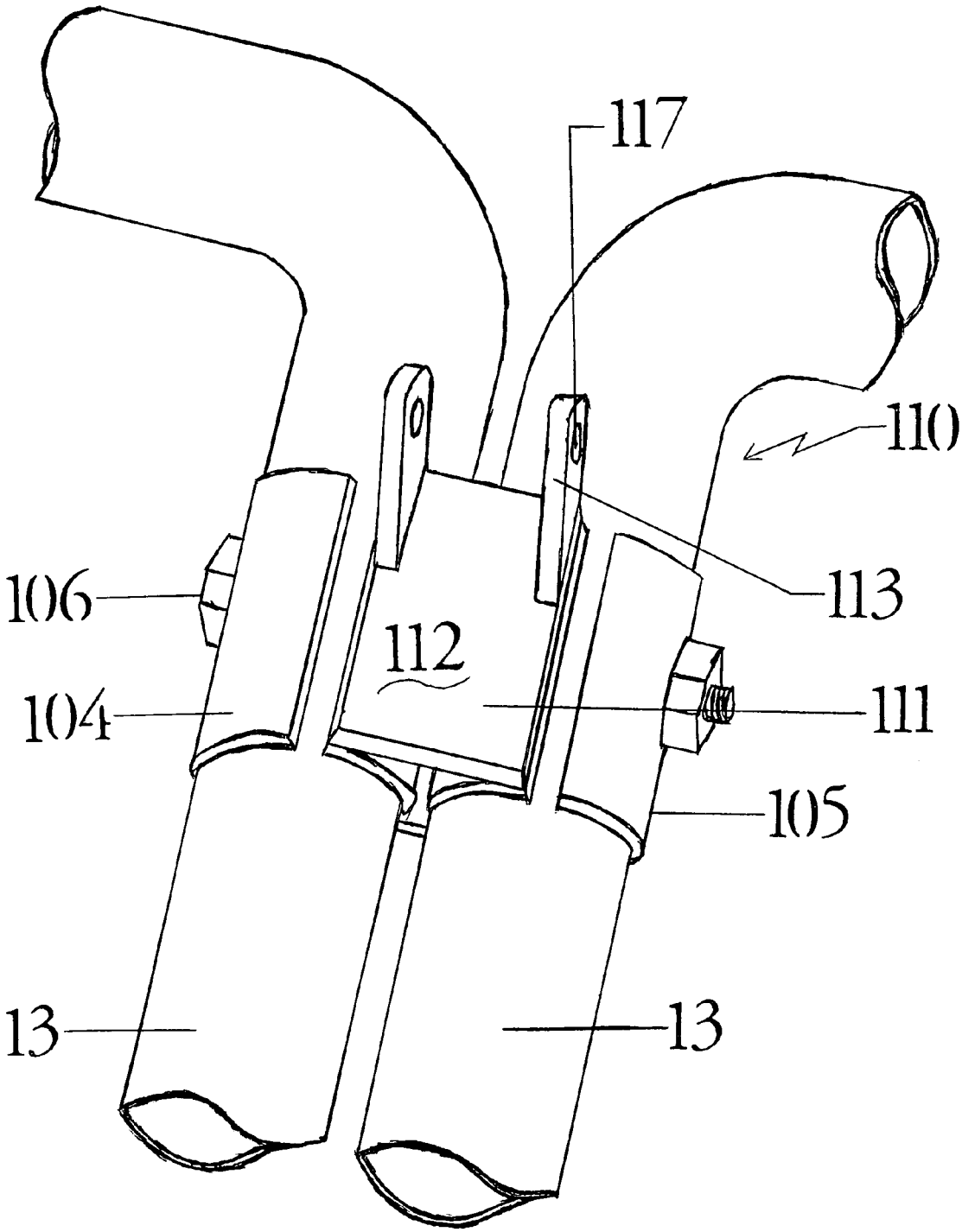
FIG. 12 is a greatly enlarged view of an upper clamp of the end member of FIG. 10.

End safety rails 80 for the embodiment of FIG. 10 are shown in FIG. 13 and comprise 2¼" automotive exhaust tubing formed into an elongated U-shape wherein end 98 is substantially the same as end 86, ends 86 and 98 telescopically engaged in ends 21 of the opposed scaffolding brackets 11. After assembling opposed scaffolding brackets 11 and inserting ends 86, 98 of safety rail 80 into ends 21 of scaffolding brackets 11, end 86, 98 are pinned to ends 21 with implement pins 43 through holes 85, 81 respectively.

Freestanding scaffolding 100 is erected by laying two step-shaped supports 12 together upon a substantially flat surface in a Y-shaped configuration wherein the downward legs 13 lay together. Step-shaped supports 12 are then joined together with bolts 106 of lower joining clamp 102 and upper coupling member 110 passing completely through downward legs 13, upper coupling member 110 arranged with standoffs 113 protruding upwardly. Nuts 107 are threaded upon the open ends of bolts 106 after placing second clamping half 105 thereupon, nuts 107 tightened securely against second clamping half 105. Adjustable outriggers 23 are placed between arcuate side braces 50, 51 of each step-shaped support 12 and are pinned thereto with farm trailer pin 35 passing through holes 34 in attachment plates 28 and hole 40 of first section 55 of adjustable outrigger 23. Adjustable outriggers 23 are then extended to a length to support walkway support 14 at the desired height and one hole 54 is then aligned with the corresponding hole 117 in arcuate side braces 50, 51 and pinned thereto with a farm trailer pin 35 and keeper 37 thus establishing tripod end member 101. End safety rails 80 are telescopically engaged into open ends 21 of both upright legs 15 of step shaped supports 12. Tripod outrigger 123 is placed between standoffs 113 of each step-shaped support 12 of tripod end member 101 and has hole 40 pinned to standoffs 113 through holes 117 with farm trailer pin 35 having keeper 37 disposed through keeper hole 38 in the end thereof. Foot end 61 of each step-shaped support 12 of tripod end member 101 is then blocked into position and tripod outrigger 123 is carried outwardly while tripod end member 101 is raised into a vertical position wherein tripod outrigger 123 is then placed upon working surface 27 and adjusted toward or away from the plane of the tripod end member 101 until tripod end member 101 is in a substantially vertical position. Foot 60 of tripod outrigger 123 may then be staked to working surface 27 to firmly affix tripod outrigger 123 in position to provide lateral support to tripod end member 101. In like manner, and opposing tripod end member 101 is assembled and raised into a substantially vertical position whereafter feet 60 of adjustable outriggers 23 are arranged to be substantially the same distance apart corresponding to the length of staging 90 to be placed upon walkway support 14 of each step-shaped support 12 of opposed tripod end members 101. As either tripod end member 101 is now freestanding, a ladder may be placed against walkway support of one of step-shaped supports 12 and staging 90 carried up a ladder placed upon walkway support 14 of opposed tripod end members 101 having hooked ends 91 hooked over walkway support 14 of each step-shaped support 12 of opposed tripod end members 101. The ladder may then be moved adjacent tripod outrigger 123 of one tripod end member 101 and staging 90 placed upon the remaining walkway support 14 of opposed tripod end members 101. Finally, safety rails 20 are assembled to connecting plates 19 on both side edges between opposed tripod end members 101. Freestanding scaffolding 100 is particularly useful inside of buildings for working in an elevated position or may be used for rapid repair of commercial or military equipment, and is expected to see particular utility in rapid removal of sensitive equipment from downed helicopters in a combat theater. Freestanding scaffolding 100 may be erected by two persons in less than five minutes using farm trailer pins 35 and implement pins 43 and may be erected by two persons in the even less time by having depressed spring bias pins 122 employed in the ends of telescoping sections 20, 23, 65 and 123. Freestanding scaffolding 100 may have feet 60 replaced with lockable scaffolding wheels for use upon a relatively smooth hard working surface 27 in the manner well known for square rigged scaffolding. In an alternate embodiment, tripod outrigger 123 may have a plurality of ladder steps placed thereupon by inserting a post of each ladder step into spaced apart staging length holes 54, 56, 58 of outrigger sections 55, 57, 59 respectively. The ladder step may be constructed of a length of 1½ inch angle having the post centrally affixed onto and protruding outwardly away from one leg of the angle. The ladder step may also be used on at least one adjustable outrigger 23 of the scaffolding system of FIG. 1.

Scaffolding system 10 may also be used to go around a corner of a building or other structure by assembling together two scaffolding units 99 in a 90 degree configuration using lower joining clamp 102 and upper coupling member 110 by match drilling holes transversely through downward leg 13 of one scaffolding bracket 11 and rotating that step-shaped support 12 ninety degrees at assembly of the two scaffolding units 99. Standoffs 113 would point away from the apex of the 90 degree angle formed by the two scaffolding brackets 111 and thus tripod outrigger 123 would extend in a plane at 45 degrees from either scaffolding bracket 11. It may be unnecessary to use adjustable outriggers 23 on scaffolding bracket 11 as tripod outrigger 123 would provide sufficient rigidity in cooperation with adjustable outriggers 23 of adjacent to scaffolding brackets 11. Curved staging (not shown) would then be hooked over walkway support 14 of the joined scaffolding brackets 11 to provide for a continuous walkway around the corner of the structure. Additionally, a curved end safety rail (not shown) may be constructed and telescopically received in ends 21 of upright legs 15 of scaffolding brackets 11 so assembled around the corner. In a similar manner, scaffolding system 10 may be arranged to be inserted into a corner of a structure, however, lower joining clamp 102 and upper coupling member 110 are assembled to upright legs 15 of two scaffolding brackets 11 in reverse relationship with the upper coupling member 110 adjacent curve 77 near walkway support 14 and lower coupling member adjacent upper ends 21 of upright legs 15. Tripod outrigger 123 would not be used in the inside corner configuration as adjustable outriggers 23 of the joined scaffolding units 99 would extend in crossed fashion, each supporting its respective scaffolding unit 99. Curved staging (not shown) would be hooked over walkway support 14 of the joined scaffolding units 99 to provide for a continuous walkway into the corner, however, no safety rail 80 would be required between the two scaffolding units 99 comprising the internal corner configuration. Safety rails 80 would, however, extend lengthwise parallel to staging 90 to each adjacent scaffolding unit 99 from the joined scaffolding units 99 inserted into the corner. Safety rails 20, end rails 80 and staging 90 are built of materials suitable for OSHA, safety rails 20 and end rails 80 arranged above staging 90 at a height as specified by OSHA. Approved material coatings are applied to the component parts of scaffolding system 10 such that scaffolding system 10 is in full compliance with OSHA regulations.

Since scaffolding system 10 of FIGS. 1–9 is structurally sound with adjustable outriggers 23 supporting scaffolding brackets 11 against wall 17 and angular cross brace 65 providing lateral support thereto and freestanding scaffolding system 10 of FIGS. 10–13 is structurally sound with tripod end members providing upward and lateral support, scaffolding system 10 may have work tables (not shown) also affixed to any support scaffolding unit 99 or at either end 83, 84 wherein the work table would have a tubular support similar to end safety rails 80 with one end of the tubular support received in end 21 and a yoke fitting over the curved section adjacent apex 29. In like manner, a hoist (not shown) may be attached to safety rails 20, end safety rails 80 or have a tubular section thereof received in end 21 of upright leg 15 wherein materials may be hoisted to the elevated position of scaffolding system 10 after erecting same adjacent wall 17 of a building. A work table may be as described in U.S. Pat. No. 4,641,728, this patent incorporated by reference herein by this reference thereto and a hoist may be as described in U.S. Pat. No. 4,078,633, issued on 14 Mar. 1978 to Michael B. Fahy, this patent also incorporated herein by this reference thereto.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. An angled brace scaffolding system comprising a plurality of scaffolding brackets, a plurality of adjustable outriggers and a plurality of stages, said plurality of adjustable outriggers rotatably affixed to and supporting individual ones of said scaffolding brackets thus comprising a plurality of scaffolding units, said scaffolding units raised into an elevated position, said plurality of stages spanning between said scaffolding brackets, wherein each of said scaffolding brackets is a single piece comprising a downwardly extending support leg rigidly affixed to one end of an horizontally disposed walkway support and an upwardly extending guard rail post rigidly affixed to the opposite end of said horizontally disposed walkway support, said support leg and said walkway support having a gusset formed therebetween for attaching one end of one of said plurality of adjustable outriggers thereupon, said plurality of scaffolding units structurally linked together wherein said gusset comprises a pair of curved plates extending from said downwardly extending support leg and said horizontally disposed walkway support, a center point of said gusset proximate the juncture between said downwardly extending support leg and said integral walkway support, said curved plates spaced apart a distance equal to the outside dimension of said downwardly extending support leg of said scaffolding bracket, said curved plates having a plurality of aligned holes disposed therethrough for affixing said adjustable outrigger in one of a plurality of defined angular positions relative to said scaffolding bracket.

2. An angled brace scaffolding system as in claim 1 wherein one of said plurality of aligned holes at said defined angular position receives a farm trailer pin therethrough, said farm trailer pin passing through one of said curved plates, said adjustable outrigger and through the other of said curved plates, said farm trailer pin retained in said holes with a keeper disposed through the free end thereof.

3. An angled brace scaffolding system as in claim 2 wherein said scaffolding bracket and said adjustable outrigger are disposed in a substantially vertical plane.

4. An angled brace scaffolding system as in claim 3 wherein said defined angular position of a first adjustable outrigger of a first said scaffolding bracket is substantially equal to said defined angular position of a second adjustable outrigger of an adjacent said scaffolding bracket wherein said angled brace scaffolding system is erected on a substantially level surface.

5. An angled brace scaffolding system as in claim 3 wherein said defined angular position of a first adjustable outrigger of a first said scaffolding bracket is different than said defined angular position of a second adjustable outrigger of an adjacent said scaffolding bracket wherein said angled brace scaffolding system is erected on an uneven surface.

6. An angled brace scaffolding system as in claim 1 wherein an adjustable brace is removably affixed to a first adjustable outrigger extending from a first scaffolding unit, said adjustable brace extending toward and removably affixed to a second adjustable outrigger extending from a second scaffolding unit.

7. An angled brace scaffolding system as in claim 6 wherein said adjustable brace has a yoke on one end and carries an adjustable clevis on the other end thereof.

8. An angled brace scaffolding system as in claim 7 wherein said yoke is releasably affixed to said first adjustable outrigger at a point below said gusset and said clevis is releasably affixed to said second adjustable outrigger adjacent a free end thereof.

9. An angled brace scaffolding system comprising a plurality of scaffolding brackets, a plurality of adjustable outriggers and a plurality of stages, said plurality of adjustable outriggers rotatable affixed to and supporting said scaffolding brackets thus comprising a plurality of scaffolding units, said scaffolding units raised into an elevated position against a wall wherein each of said scaffolding brackets is a single piece comprising a downwardly extending wall support leg rigidly affixed to one end of an horizontally disposed walkway support and an upwardly extending guard rail post rigidly affixed to the opposite end of said horizontally disposed walkway support, said wall support leg and said walkway support having a gusset formed therebetween for attaching one end of one of said plurality of adjustable outriggers thereupon, said plurality of stages spanning between and removably affixed to said scaffolding brackets thus structurally linking said plurality of scaffolding units together wherein said scaffolding bracket has a pair of arcuate braces spaced outwardly from said gusset, said arcuate braces extending outwardly from said downwardly extending support leg and downwardly from said horizontally disposed walkway support, said arcuate braces spaced apart a distance equal to the outside dimension of said downwardly extending support leg, said arcuate braces having a plurality of aligned holes disposed therethrough for affixing said adjustable outrigger in one of a plurality of defined angular positions relative to said scaffolding bracket.

10. An angled brace scaffolding system as in claim 9 wherein one of said plurality of aligned holes at said defined angular position receives a farm trailer pin therethrough, said farm trailer pin passing through said one of said arcuate braces, said adjustable outrigger and through the other of said arcuate braces, said farm trailer pin retained in said aligned holes with a keeper disposed through the free end thereof.

11. An angled brace scaffolding system as in claim 9 wherein adjacent ones of said scaffolding brackets have safety guard rails removably affixed to upper ends of said upwardly extending guard rail posts thereof, said safety guard rails providing additional structural support to said angled brace scaffolding system.

12. An angled brace scaffolding system as in claim 11 wherein an adjustable brace is removably affixed to a first adjustable outrigger extending from a first scaffolding unit, said adjustable brace extending toward and removably affixed to a second adjustable outrigger extending from a second scaffolding unit.

13. An angled brace scaffolding system as in claim 12 wherein said adjustable brace has a yoke on one end and carries an adjustable clevis on the other end thereof.

14. An angled brace scaffolding system as in claim 13 wherein said yoke is releasably affixed to said first adjustable outrigger at a point below said gusset and said clevis is releasably affixed to said second adjustable outrigger adjacent a free end thereof.

15. An angled brace scaffolding system as in claim 9 wherein said adjustable outrigger comprises a plurality of telescoping sections, each successive telescoping section progressively smaller in cross section than the next lower section, said plurality of telescoping sections having a plurality of aligned pin holes disposed transversely through the opposed side walls thereof, said aligned pin holes adapted to receive an implement pin therein for fixing said plurality of telescoping sections into a predefined length.

16. An angled brace scaffolding system as in claim 15 wherein said adjustable outrigger carries a removable foot upon the free end thereof.

17. An angled brace scaffolding system as in claim 16 wherein said foot further comprises an enlarged spike which may be withdrawn into said free end.

* * * * *